United States Patent [19]

Kubotera et al.

[11] 4,157,262

[45] Jun. 5, 1979

[54] INTENSIFICATION OF PHOTOGRAPHIC SILVER IMAGES BY PHYSICAL DEVELOPMENT AND IMPROVEMENT IN PHYSICAL DEVELOPER SOLUTION FOR USE THEREIN

[75] Inventors: Kikuo Kubotera; Akira Kashiwabara; Kotaro Sato; Hisatake Ono; Hideo Sato; Yuzo Mizobuchi, all of Asaka, Japan

[73] Assignee: Fuji Photo Film Co., Ltd., Minima-ashigara, Japan

[21] Appl. No.: 791,916

[22] Filed: Apr. 28, 1977

[30] Foreign Application Priority Data

| | | | |
|---|---|---|---|
| Apr. 28, 1976 | [JP] | Japan | 51-49084 |
| Apr. 30, 1976 | [JP] | Japan | 51-49666 |
| Nov. 4, 1976 | [JP] | Japan | 51-132930 |

[51] Int. Cl.[2] ..... G03C 5/24; G03C 5/54; G03C 5/32

[52] U.S. Cl. ..... 96/29 R; 96/48 PD; 96/60 R

[58] Field of Search ..... 106/1.26, 1.27, 1.05; 96/48 PD, 60, 29

[56] References Cited

U.S. PATENT DOCUMENTS

| | | | |
|---|---|---|---|
| 2,942,990 | 6/1960 | Sullivan | 106/1.27 |
| 3,045,334 | 7/1962 | Berzins | 106/1.27 |
| 3,338,726 | 8/1967 | Berzins | 106/1.27 |
| 3,373,054 | 3/1968 | Lang et al. | 106/1.27 |
| 3,647,450 | 3/1972 | Calligaris et al. | 96/50 |
| 3,650,748 | 3/1972 | Yudelson et al. | 96/48 PD |
| 3,745,039 | 7/1973 | Feldstein | 106/1.27 |
| 3,822,127 | 7/1974 | Tsuboi et al. | 96/48 PD |
| 3,846,591 | 11/1974 | Case | 96/48 PD |
| 3,935,013 | 1/1976 | Lelental | 96/48 PD |
| 3,946,126 | 3/1976 | Feldstein | 106/1.27 |
| 3,993,801 | 11/1976 | Feldstein | 106/1.26 |

*Primary Examiner*—Mary F. Kelley

*Attorney, Agent, or Firm*—Sughrue, Rothwell, Mion, Zinn and Macpeak

[57] ABSTRACT

A process for intensifying a silver image formed photographically to obtain a non-silver metal image of high optical density comprising treatment with a non-silver physical developer solution containing (1) at least one of an amine borane compound and a borohydride compound, (2) at least one of an amine compound and an ammonium compound, and (3) a compound of a non-silver metal, within a specified temperature range and the non-silver physical developer solution used therein.

5 Claims, 8 Drawing Figures

4.0
3.0
2.0
1.0
0
OPTICAL DENSITY
I-2
CI-5
Ag
CI-2
3.0
2.0
1.0
0.0
1.0
2.0
EXPOSURE AMOUNT (RELATIVE)
(LOGARITHM)

4.0
3.0
2.0
1.0
0
OPTICAL DENSITY
2-2
Ag
C2-2
3.0
2.0
1.0
0.0
1.0
2.0
EXPOSURE AMOUNT (RELATIVE)
(LOGARITHM)

OPTICAL DENSITY
4.0
3.0
2.0
1.0
0
317
318
315
325
302
310
301
3.0
2.0
1.0
0.0
1.0
2.0
EXPOSURE AMOUNT (RELATIVE) → (LOGARITHM)

OPTICAL DENSITY
4.0
3.0
2.0
1.0
0
332
331
341
335
338
340
301
3.0
2.0
1.0
0.0
1.0
2.0
EXPOSURE AMOUNT (RELATIVE) → (LOGARITHM)

OPTICAL DENSITY
4.0
3.0
2.0
1.0
0
4
Ag
3.0
2.0
1.0
0
1.0
2.0
EXPOSURE AMOUNT (RELATIVE) → (LOGARITHM)

OPTICAL DENSITY
4.0
3.0
2.0
1.0
0
8D
8C
8B
8A
Ag
3.0
2.0
1.0
0
1.0
2.0
EXPOSURE AMOUNT (RELATIVE) → (LOGARITHM)

INTENSIFICATION OF PHOTOGRAPHIC SILVER IMAGES BY PHYSICAL DEVELOPMENT AND IMPROVEMENT IN PHYSICAL DEVELOPER SOLUTION FOR USE THEREIN

BACKGROUND OF THE INVENTION

1. Field of the Invention

This invention relates to a process for intensifying photographic silver images by physical development, and to an improvement in a physical developer for use in this process. More specifically, it relates to a process for reproducing photographic images of increased optical density from photographically formed silver images by physical development (intensification) using non-silver metals.

2. Description of the Prior Art

The developing operation, which plays an important role in processing silver halide photographic materials to form images thereon, embraces chemical development and physical development both of which are well known.

In chemical development, a silver halide in a photographic material is exposed and subjected to the action of a developer solution comprising a developing agent for reducing the silver halide, such as Metol (tradename for p-methylaminophenol sulfate) and hydroquinone, and developing aids, whereby the silver halide is reduced to silver and deposits mainly where the latent image formed by exposure exists in the silver halide crystals.

Physical development, on the other hand, comprises treating a nucleus (latent-image silver) or print-out image silver formed by exposure (these types of silver will be inclusively referred to hereinbelow as "image-forming silver") with a developer solution containing a silver ion and a reducing agent thereby to deposit silver on the nucleus and intensify it. Hence, in physical development, the image-forming silver is supplied from the silver ion in the developer solution. A diffusion transfer development method whereby silver halide in the photographic layer is first converted to a complex salt and dissolved, and then reduced is sometimes classified as physical development.

The chemical development method has been the predominant technique used in the processing of silver halide photographic materials in general, and has gained widespread acceptance because it can give rise to superior characteristics such as sensitivity, tone reproduction, or a well balanced combination of resolution and sensitivity in photographic materials. In contrast, the physical development method has not been commercially accepted to any substantial extent except in specialized applications, because it is inferior to chemical development in a number of respects in spite of its ability to provide ultrafine graininess, high resolution, and high covering power. For example, physical development results only in low sensitivity and requires a long developing time, and moreover, physical developer solutions are chemicaly unstable.

However, both chemical development and physical development have the common disadvantage that the silver used to form images is very costly. In an attempt to remove this disadvantage, extension investigations have been performed in recent years for making images of the desired photographic characteristics by using lesser amounts of silver in chemical development. Investigations have also been conducted on improved methods of physical development wherein the amount of silver in the photographic layer of a photographic material used is reduced, and a silver image is first formed although in a low density, after which the low density silver image is intensified by treatment with a physical developer solution containing a metal more base than silver (i.e., a metal having an ionization tendency higher than that of silver hereinafter for brevity a "metal more base than silver" or "non-silver metal"), such as cobalt, nickel or copper, thereby depositing the metal on the silver image and affording a metal image of the desired optical density. For example, U.S. Pat. No. 3,650,748 discloses a method which comprises chemically developing a silver halide photographic material, subjecting the developed material to an activating treatment, and then physically developing it with a metal more base than silver, such as cobalt, nickel or copper. Various other types of physical development methods are described, for example, in U.S. Pat. Nos. 2,532,284, 2,690,401, 2,690,402, 2,726,969, 2,762,733, 2,871,142, and 3,011,920, French Pat. Nos. 2,938,805, 1,225,194 and 1,182,849, and Belgian Pat. No. 637,058. All of these methods, however, require an activating treatment (pre-treatment). In using nickel or cobalt, the photographic material is treated with an acid solution of stannous chloride and further with a palladium salt. Treatment with silver nitrate, for example, is necessary in using copper. This activating treatment is for the purpose of treating the silver image with a metal catalyst, for example a solution of a noble metal salt such as palladium, gold or platinum salt to deposit a nucleus of the metal on the surface of the silver image, and imparting a catalytic ability to the silver image for subsequent physical development.

Such a physical development process is being exploited as one characteristic process of silver halide photographic processes. The process would be more advantageous if a material which has the same function as a silver nucleus can be directly produced by the action of light or development at the time of physically developing the photographic layer. In other words, an imaging process combining chemical development of silver halide and the physical development of a non-silver metal is desirable since the amplification action in the step of rendering the image visible is twofold and the treatment is simple. Hence, the advent of such an imaging process has long been desired in the art.

According to the prior techniques, a developed silver image obtained by subjecting a silver halide photographic material to a series of exposure, development and fixation, or a nucleus (latent-image silver) or print-out silver image obtained by light exposure and fixation cannot be directly intensified by physical development with a non-silver metal (chemical plating by a non-silver metal). Known reducing agents used in the conventional physical developers containing non-silver metals include, for example, formaldehyde, hypophosphites, borohydride compounds, hydrazine compounds, and amine borane compounds. However, reducing agents which cause the direct deposition of non-silver metals on the silver nucleus or developed silver formed from silver halide photographic material, and physical developer solution containing such reducing agents have not been known heretofore.

U.S. Pat. No. 3,650,748 discloses that a chemically developed silver is inert to physical development, and cannot be a nucleus for non-silver metal physical development.

In other words, this patent teaches that a metal more base than silver does not deposit in the region of developed exposed silver. Such silver is not a catalyst for reduction in physical development. This patent discloses a process for image reproduction by physical development using a metal more base than silver, which comprises activating such silver with a salt of a metal more noble than silver (e.g., platinum, palladium or gold), a mineral acid such as nitric acid, hydrochloric acid, sulfuric acid or sulfurous acid, a strong oxidizing agent such as potassium ferricyanide or hydrogen peroxide, or a reducing agent such as sodium borohydride thereby to form an active nucleus on the surface of or surrounding the silver image; and then contacting the photographic material containing this silver image with a physical developer solution containing a salt of a metal such as copper, nickel, cobalt or iron and an amine borane reducing agent. The purpose of activation is to deposit copper, nickel, cobalt, iron or the like selectively on the silver image. In other words, since the photographically formed developed silver is inert to physical development with a salt of a metal more base than silver a catalytic nucleus is required. The catalytic nucleus is provided by forming an active nucleus on the surface of or surrounding the silver image.

SUMMARY OF THE INVENTION

It has now been found surprisingly that when a silver image obtained by photographic processing or a light deposited silver image is immersed in a physical developer which contains a water-soluble salt of a metal more base than silver (e.g., nickel, cobalt, copper and iron; to be referred to hereinbelow simply as a non-silver metal) as a supply source of a metal ion, dimethylamine borane as a reducing agent, and an amine compound or ammonium compound as a physical development initiator (acting as a physical development accelerator and a complexing agent) and the temperature of the development solution is increased to about 35° C., the silver image can be selectively intensified with the non-silver metal. On further investigations, it has been found that the silver image can be similarly intensified directly with a non-silver metal by using other amine boranes and borohydride compounds such as sodium borohydride as reducing agents, and that when borohydride compounds are used, the silver image can be directly intensified with the non-silver metal even at a temperature of as low as about 15° C.

An object of this invention is therefore to provide a process for forming photographic images wherein a silver halide photographic material containing a very small amount of silver halide is used for recording a photoimage, and the silver image formed by this small amount of silver can be directly intensified with a non-silver metal having a greater ionizing tendency than silver.

Another object of the invention is to provide a process for producing non-silver images by utilizing the high sensitivity to visible light of silver halide photographic materials.

Still another object of the invention is to provide photographic images by using silver images and non-silver images in combination.

Yet another object of this invention is to provide a process for forming non-silver images which requires the use of only a small amount of silver.

A further object of this invention is to provide a process for reproducing stable non-silver images having a high degree of sharpness and contrast.

Also an object of this invention is to provide a process for producing fog-free non-silver images by physical development.

Accordingly the present invention provides a process for forming photographic images, which comprises applying a non-silver physical developer solution containing (1) at least one boron compound selected from the group consisting of amine borane compounds and borohydride compounds, (2) at least one compound selected from the group consisting of amine compounds and ammonium compounds, and (3) a compound of a metal different from silver, to a silver image formed by a photographic method.

In another embodiment of this invention, the invention provides a physical developer solution which comprises (1) at least one boron compound selected from the group consisting of amine borane compounds and borohydride compounds, (2) at least one compound selected from the group consisting of amine compounds and ammonium compounds, and (3) a compound of a non-silver metal.

Figure 1:
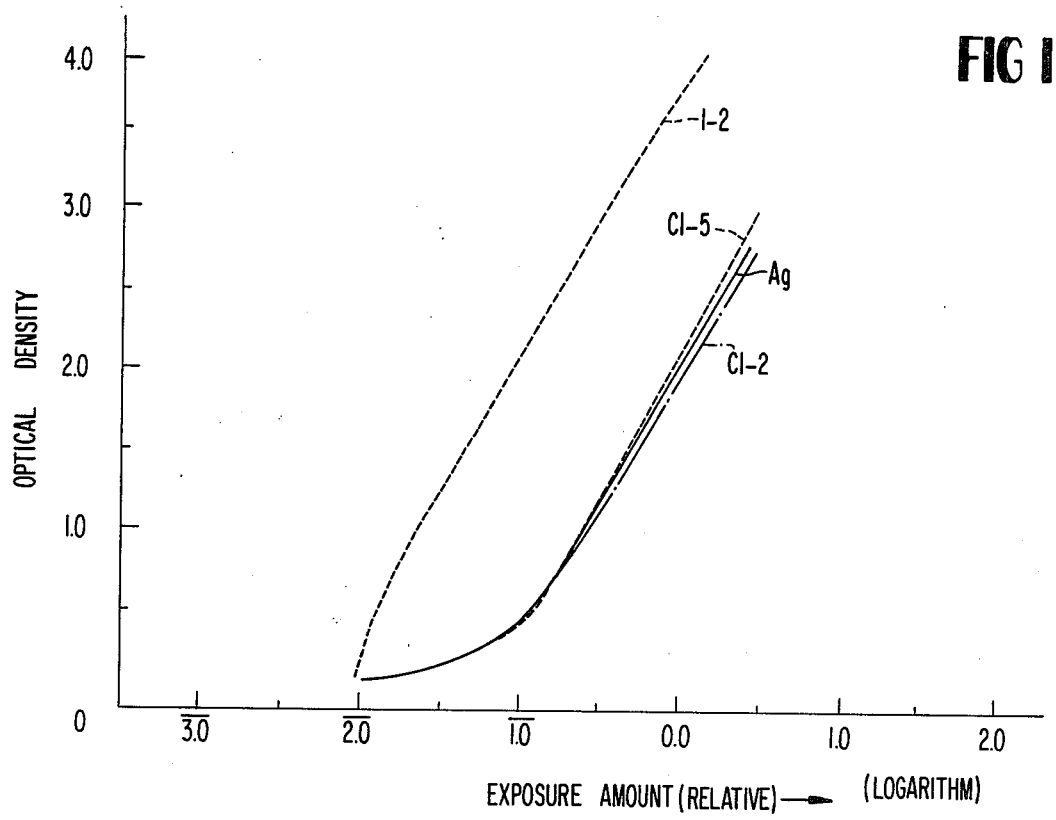
FIG. 1 shows sentitometric curves of images obtained in Example 1 and Comparative Example 1.

In all of these Figures, the curves marked "Ag" are sensitometric curves of silver images which were not intensified (not developed physically), and curves with other symbols or numerals are sensitometric curves of images intensified by treatment with the corresponding physical developer solutions.

DETAILED DESCRIPTION OF THE INVENTION

Examples of suitable amine borane compounds which can be used as the first component are those represented by the following general formula (Ia)

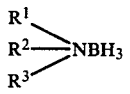

(Ia)

wherein each of $R^1$, $R^2$ and $R^3$, which can be the same or different, each represents a straight-chain, branched-chain or cyclic alkyl group containing 1 to 12 carbon atoms, an aralkyl group containing 7 to 12 carbon atoms, an aryl group, an amino group or a hydrogen atom; with the proviso that when either one of $R^1$, $R^2$ and $R^3$ is an amino group, the other two are not amino groups, and that all of $R^1$, $R^2$ and $R^3$ are not hydrogen atoms at the same time; and the alkyl, aralkyl or aryl group may be substituted with one or more of a hydroxyl group or an amino group; or represented by the general formula (Ib)

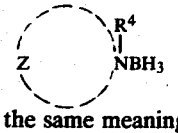

(Ib)

wherein $R^4$ has the same meaning as $R^1$ in general formula (Ia), and Z represents an atomic grouping required to form a saturated or unsaturated 5- or 6-membered N-containing heterocyclic ring with the proviso that when there is a double bond to the N atom, $R^4$ is not present; and the above group or atomic grouping may be substituted with one or more of a hydroxyl group or an amino group.

Specific examples of $R^1$, $R^2$ and $R^3$ in general formula (Ia) are methyl, ethyl, propyl butyl, pentyl, hexyl, octyl, decyl, dodecyl, isopropyl, isobutyl, isopentyl, isohexyl, secbutyl, 1-methylpentyl, 1-methylhexyl, tert-butyl, neopentyl, tert-pentyl, 1,1-dimethylhexyl, cyclopentyl, cyclohexyl, 2-norbornyl, benzyl, phenethyl, 3-phenylpropyl, 2-phenylpentyl, 1-naphthylmethyl, 2-(1-naphthyl)ethyl, phenyl, 1-naphthyl, 2-naphthyl, 1-biphenylyl, hydroxymethyl, 2-hydroxyethyl, 2-hydroxypropyl, 3-hydroxypropyl, 3-hydroxybutyl, 4-hydroxycyclohexyl, p-hydroxyphenyl, 1-hydroxy-2-naphthyl, aminomethyl, 2-aminoethyl, 2-aminobutyl, and amino groups, and a hydrogen atom.

Specific examples of compounds expressed by general formula (Ia) include methylamine borane, dimethylamine borane, trimethylamine borane, ethylamine borane, diethylamine borane, triethylamine borane, ethanolamine borane, diethanolamine borane, triethanolamine borane, propylamine borane, dipropylamine borane, tripropylamine borane, 3-hydroxypropylamine borane, butylamine borane, pentylamine borane, isopropylamine borane, t-butylamine borane, aniline borane, ethylenediamine borane, trimethylenediamine borane, and hydrazine borane.

Examples of $R^4$ in general formula (Ib) are the same as those of $R^1$, $R^2$or $R^3$ in general formula (Ia). Specific examples of the heterocyclic rings formed by Z in general formula (Ib) are pyrrolidine, piperidine, quinacridine, pyrrole, 3-pyrroline, pyridine, 2-methylpyridine, 3-methylpyridine, 4-methylpyridine, 2-ethylpyridine, 4-ethylpyridine, 2-propylpyridine, 3-propylpyridine, 4-propylpyridine, 2,6-lutidine, 3,4-lutidine, 2,4-lutidine, 2,4-diethylpyridine, 2,6-diethylpyridine, 3,4-diethylpyridine, 2,6-propylpyridine, 4-hydroxypiperidine, and 4-hydroxypyridine.

Specific examples of compounds represented by general formula (Ib) include pyridine borane, 2,6-lutidine borane, 3,4-lutidine borane, 2,4-lutidine borane, 2-ethylpyridine borane, 2,4-diethylpyridine borane, 2,6-diethylpyridine borane, 3,4-diethylpyridine borane, 2-propylpyridine borane, 3-propylpyridine borane, 4-propylpyridine borane, ethylenediamine borane, trimethylenediamine borane, and hydrazine borane.

The borohydride compounds can be represented by the general formula (Ic)

$$MBH_4 \qquad \text{(Ic)}$$

wherein M is an alkali metal such as lithium, sodium or potassium. Specific examples of borohydride compounds include, for example, lithium borohydride, sodium borohydride and potassium borohydride.

Especially preferred boron compounds (1) are sodium borohydride, dimethylamine borane, trimethylamine borane, diethylamine borane, triethylamine borane, tert-butylamine borane, pyridine borane, 2,6-lutidine borane, ethylenediamine borane, and hydrazine borane.

The boron compounds (1) can be used either individually or as an admixture of two or more thereof.

Amine compounds which can be used as component (2) are those represented by the following formula (IIa)

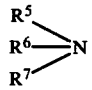

(IIa)

wherein each of $R^5$, $R^6$ and $R^7$, which may be the same or different, represents a straight-chain, branched-chain or cyclic alkyl group containing 1to 12 carbon atoms, an aralkyl group containing 7 to 12 carbon atoms, an aryl group, an amino group, or a hydrogen atom; with the provisio that when one of $R^5$, $R^6$ or $R^7$ is an amino group, the other two are not amino groups, and they are not hydrogen atoms at the same time; or represented by the following formula (IIb)

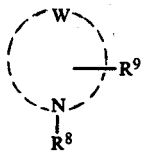

(IIb)

wherein W represents an atomic grouping comprising carbon, nitrogen or oxygen atoms as required to form a saturated or unsaturated, 5-, 6- or 7-membered aromatic heterocyclic ring; $R^8$ has the same meaning as $R^5$, and $R^9$ has the same meaning as $R^5$ or represents a hydroxyl group, an amino group, a mono- or di-alkylamino group (with the alkyl moiety being a straight chain or branched chain alkyl group and containing 1 to 5 carbon atoms), an oxo group, an alkoxycarbonyl group (with the alkyl moiety containing 1 to 5 carbon atoms and being a straight chain or branched chain alkyl group), an amido group (with the acyl moiety containing 2 to 5 carbon atoms), an acyloxy group (with the acyl moiety containing 2 to 5 carbon atoms), an alkoxy group (with the alkyl moiety containing 1 to 5 carbon atoms and being a straight chain or branched chain alkyl group), an aryloxy group (with the aryl group being a phenyl or naphthyl group), a cyano group or a halogen atom (such as chlorine, bromine or iodine), with the proviso that when there is a double bond to the N atom, $R_8$ is not present.

Each of the groups for $R^5$, $R^6$ and $R^7$ in general formula (IIa) may be substituted with one or more of a hydroxyl group, an amino group, a mono- or di-alkylamino group (with the alkyl moiety being a straight chain or branched chain alkyl group and containing 1 to 5 carbon atoms), an oxo group, a carboxyl group, an alkoxycarbonyl group (with the alkyl moiety being a straightchain or branched chain alkyl group and containing 1 to 5 carbon atoms, an amido group (with the acyl moiety containing 2 to 5 carbon atoms), an acyloxy group (with the acyl moiety containing 2 to 5 carbon atoms), an alkoxy group (with the alkyl moiety being a straight chain or branched chain alkyl group and containing 1 to 5 carbon atoms), an aryloxy group (with the aryl group being a phenyl or naphthyl group), a cyano group, or a halogen atom (such as chlorine, bromine or iodine).

Specific examples of groups for $R^5$, $R^6$ and $R^7$ in general formula (IIa) include those set forth above for $R^1$ and additionally include methylamino, dimethylamino, ethylamino, diethylamino, butylamino, isopropylamino, aminomethyl, 2-aminoethyl, 2-aminopropyl, 4-aminobutyl, 5-aminopentyl, 6-aminohexyl, 2-(methylamino)ethyl, 2-(dimethylamino)ethyl, 2-(2-hydroxyethylamino)ethyl, 3,6,9-triazanonyl, carboxymethyl, 2-carboxyethyl, 1,1-bis(hydroxymethyl)ethyl, 1,1-bis(hydroxymethyl)propyl and tris(hydroxymethyl)methyl groups.

Specific examples of compounds of general formula (IIa) include methylamine, ethylamine, propylamine, isopropylamine, butylamine, tert-butylamine, sec-butylamine, isobutylamine, amylamine, isoamylamine, hexylamine, dimethylamine, diethylamine, dipropylamine, diisopropanolamine, triisopropanolamine, monoethanolamine, diethanolamine, triethanolamine, N-methyl ethanolamine, N-ethyl ethanolamine, diethylaminoethanol, isopropanolamine, propanolamine, triisopropanolamine, isopropanolamine, N-aminoethyl ethanolamine, 2-amino-2-methyl-1,3-propanediol, 2-amino-2-ethyl-1,3-propanediol, 2-amino-2-hydroxymethyl-1,3-propanediol, hydrazine, ethylenediamine, trimethylenediamine, propylenediamine, tetramethylenediamine, pentamethylenediamine, hexamethylenediamine, 2-(2-hydroxyethylamino)ethylamine, N,N'-dimethyl ethylenediamine, N,N,N',N'-tetramethyl ethylenediamine, triethylenetetramine, glycine, cyclohexylamine, dicyclohexylamine, and N,N-diethylaniline.

Specific examples of $R^9$ in general formula (IIb) include hydroxyl, amino, methylamino, dimethylamino, N-methyl-N-ethylamino, butylamino, isoropylamino, oxo (i.e., =0), carboxyl, methoxy, ethoxy, propoxy, butoxy, isopropoxy, phenoxy, 1-naphthyloxy, 2-naphthyloxy, acetamido, propanamido, acetoxy, propionyloxy, and cyano groups and chlorine, bromine and iodine atoms in addition to the specific examples given for $R^5$ hereinabove.

Specific examples of the heterocyclic rings formed by W in general formula (IIb) are pyrrolidine, piperidine, pieprazine, morpholine, 3-pyrroline, pyrrole, pyridine, imidazolidine, pyrazolidine, perhydropyridazine, imidazole, pyrazole, 2-imidazoline, and pyrazine.

Specific examples of compounds expressed by general formula (IIb)) are morpholine, diethanolamine, -pyrrolidone, N-methyl-2-pyrrolidone, ethyleneurea, imidazole, 2-methylimidazole, and N-methylimidazole.

Especially preferred amine compounds of the formulas (IIa) and (IIb) are ethanolamine, diethylamine, triethanolamine, N-methyl ethanolamine, N-ethyl ethanolamine, methylamine, dimethylamine, trimethylamine, ethylamine, diethylamine, triethylamine, propylamine, isopropylamine, 2-amino-2-methyl-1,3-propanediol, 2-amino-2-ethyl-1,3-propanediol, ethylenediamine, propylenediamine, trimethylenediamine, and 2-(2-hydroxyethylamino)ethylamine [or N-(hydroxyethyl)ethylenediamine].

Furthermore, in accordance with the present invention suitable amine compounds as component (2) also include salts of compounds of the formula (IIa) or (IIb) with acids such as acetic acid, propionic acid, oxalic acid, citric acid, sulfuric acid, nitric acid, phosphoric acid, carbonic acid, hydrogen chloride, hydrogen bromide or hydrogen iodide.

Suitable examples of ammonium compounds for component (2) include, for example, ammonia (or an ammonia solution), and ammonium salts of inorganic acids. Examples of suitable ammonium salts of inorganic acids are ammonium chloride, ammonium bromide, ammonium iodide, ammonium nitrate, ammonium sulfate, ammonium dihydrogen phosphate, diammonium hydrogen phosphate, ammonium phosphate, ammonium chlorate, and ammonium bromate. Examples of suitable ammonium salts of organic acids include ammonium hydrogen oxalate, ammonium oxalate, ammonium dihydrogen citrate, diammonium hydrogen citrate, ammonium citrate, and ammonium acetate. Preferred ammonium compounds are ammonium chloride, ammonium bromide, ammonium nitrate, ammonium sulfate, ammonium dihydrogen phosphate, diammonium hydrogen phosphate, ammonium phosphate, ammonium oxalate, and diammonium hydrogen citrate. If these, ammonium chloride, ammonium sulfate, ammonium dihydrogen phospate, diammonium hydrogen phosphate, ammonium oxalate, and diammonium hydrogen citrate are especially preferred.

At least one compound selected from the above-exemplified amine and ammonium compounds is used as the second component of the physical developer solution of the invention.

Compounds of non-silver metals, used as the third component of the physical developer solution of the present invention, are compounds of metals more base than silver, more specifically, metals of Group VIII of the Periodic Table such as nickel, cobalt and iron and metals of Group IB of the Periodic Table such as copper. These metal compounds are employed in the form of the water-soluble salts thereof. The chlorides, sulfates, acetates, formates, nitrates, and amine complex salts of these metals are suitable water-soluble metal salts which can be generally used. Specific examples of metal compounds are nickel (II) chloride, cobalt (II) chloride, copper (II) chloride, copper (II) sulfate, nickel (II) sulfate, cobalt (II) sulfate, iron (II) sulfate, nickel (II) acetate, cobalt (II) acetate, copper (II) acetate, copper (II) formate, nickel (II) nitrate, cobalt (II) nitrate, copper (II) nitrate, hexamminecobalt (III) chloride, and hexamminenickel (II) chloride.

The three components described above are employed as essential ingredients in the physical developer solution used in the present invention. If desired, other additives such as pH adjusters or auxiliary complexing agents may be incorporated in the developer.

The pH of the physical developer very greatly affects the speed of physical development, the efficiency of utilizing the reducing agent, and the characteristics of the metal deposited, and varies as the physical development progresses. The control of the pH during physical development is extremely important. Suitable pH adjusters include inorganic acids, organic acids (the same as those used as complexing agents), alkali metal hydroxides, amine compounds or ammonium compounds used as the second component of the physical developer, and combinations of two or more of these materials. Specific examples of pH adjusters which can be used are sodium hydroxide, potassium hydroxide, sodium carbonate, sulfuric acid, and hydrochloric acid. A suitable pH for a given formulation may be selected within a range of a pH of about 3 to about 14, preferably 8 to 13.5. The use of alkaline physical developers is advantageous for controlling the speed of physical development and for the preparation and control of the physical developer solution.

As the physical development progresses, the metal ion concentration decreases, and the hydrogen ion concentration correspondingly increases to cause a decrease in the pH of the physical developer. The decrease in pH must be inhibited to the greatest possible extent because the pH is related to the driving power of the reducing reaction and a decrease in pH decreases the speed of physical development and changes the characteristics of the metal deposited. For this purpose, a pH buffer is added to the physical developer. Buffering of pH can be achieved generally by causing a weak acid and the alkali metal salt of the weak acid to be copresent in the solution.

The complexing agent for reducible metal ions in the physical developer solution is added for the purpose of preventing a precipitation of the metal in the physical developer and dissolving it in a fixed concentration. The complexing agent combines with the metal ion to form a complex so that it will not be naturally reduced in the presence of a reducing agent. However, if the complexing agent combines too strongly with the metal ion and forms a stable complex, the concentration of the free metal ion in the developer decreases drastically and the speed of deposition of the metal is retarded. Such strong complexing agents are not suitable in the present invention.

Some compounds may act both as a complexing agent and a component for a pH buffer. Such compounds are, for example, acetic acid, oxalic acid, succinic acid, malonic acid, maleic acid, glycolic acid, lactic acid, tartaric acid, citric acid, gluconic acid, and malic acid. Examples of pH buffers include inorganic acids such as boric acid, carbonic acid or sulfurous acid in combination with an appropriate salt thereof.

The physical developer solution of this invention is prepared by dissolving these components (1), (2) and (3) along with any additives in water. The amine borane compound can be present in the physical developer solution in an amount of about 0.1 g up to saturation, preferably about 0.5 g up to saturation, most preferably about 1 g to about 200 g, per liter of the developer solution. When the physical developer is to be applied at a relatively low temperature of above about 18° C., preferably above about 23° C., the amine borane compound can be present in an amount of at least about 50 g, preferably at least about 80 g, per liter of the developer solution. The borohydride compound can be employed in an amount of about 0.01 g up to saturation, preferably about 0.1 g to about 100 g, most preferably about 1 g to about 50 g, per liter of the physical developer solution. When the borohydride compound and the amine borane compound are used in combination, the amounts thereof may be chosen appropriately from the ranges specified above.

The amine compound as a second component can be present in an amount of about 0.1 g up to saturation, preferably about 0.5 g to about 950 g, most preferably about 1 g to about 700 g, per liter of the physical developer solution. The ammonium compound can be present in an amount of about 0.01 g up to saturation, preferably about 0.05 g to about 950 g, most preferably about 10 g to about 700 g, per liter of the physical developer solution.

The concentration of the non-silver metal salt in the physical developer is about 0.01 to about 1 mole preferably about 0.05 to about 0.5 mol per liter of the developer.

The ratio between the non-silver metal salt and the complexing agent differs depending on the types thereof. The complexing agent should be employed in an amount sufficient for the complexing agent to combine with the non-silver metal ion and to reduce the tendency of the metal ion toward reduction before using the developer. Depending upon the types of the non-silver metal salt and the complexing agent used, the amount of the complexing agent can be varied within the range of about 0.2 mole to about 10 moles per mole of the non-silver metal salt.

The physical developer solution so prepared is applied to silver images which are formed using various known photographic processes. Specifically, a silver halide photographic material is exposed through an image-bearing transparency, developed (this step is omitted when light deposited silver images are formed), and fixed to form an image composed of silver generated in the exposed area of the photographic layer (light deposited silver when the development is omitted), and the silver image is contacted with the physical developer solution of the present invention. This results in the physical development of the silver image, and the non-silver metal (a reduction product of the non-silver metal ion from the non-silver metal compound) is deposited on the silver image from the physical developer solution. Hence, an activation treatment is not required in this process unlike conventional processes for forming such a metal image, and the cost is extremely low because a noble metal salt is not used. The process further has advantages such as a very high sensitivity, a sensitivity over the entire region of visible light, a good tone reproduction, and high resolution. The continuous gradation of the original silver image can be reproduced on the intensified image by apropriately selecting the amounts of the reducing agent and complexing agent included in the physical developer solution containing the non-silver metal or the temperature and time of the physical development. Alternatively the selection may lead to intensified images having high contrast or ultra-high contrast quite different from the gradation of the original silver image.

When a photographic material comprising a support and a layer containing a chalcogen compound (a compound containing at least one of sulfur, selenium and tellurium) and a silver layer formed on the chalcogen compound layer is exposed imagewise and optionally heat-treated, and the silver image obtained is treated by the process of this invention, the non-silver metal can be deposited selectively on the silver image. The process of the invention can of course be applied to other types of non-silver halide photographic materials.

The process of the invention is described below in greater detail.

When the process of the invention is to be applied to silver halide photographic materials, a photographic material is exposed imagewise, developed (the development may be omitted as described hereinbefore), and fixed, and then a physical developer solution containing a non-silver metal compound is applied to the silver image thereby to produce a non-silver (non-silver metal) image of high quality. Typical processing methods include:

(1) a method which comprises exposing imagewise a photographic material comprising a support and a silver halide emulsion layer thereon, either directly or through at least one subbing layer, fixing the material to remove silver halide in the unexposed area, and then treating the silver image with the physical developer of this invention to intensify the light deposited silver with the non-silver metal (the term "light deposited silver" as used herein means an invisible latent silver or visible print-out silver directly produced from (or in) the silver halide grain by light exposure);

(2) a method which comprises subjecting the same type of photographic material as described in (1) above to imagewise exposure, development and fixation to remove silver halide in the unexposed area, and then treating the silver image with the physical developer of this invention to intensify the developed silver image with the non-silver metal;

(3) a method which comprises fixing the same type of photographic material as described in (1) above without exposure thereby to dissolve and remove a greater portion of the silver halide, exposing the material imagewise to form a light deposited silver image, and treating the image with the physical developer of this invention thereby to intensify the light deposited silver image with the non-silver metal;

(4) a method which comprises washing the emulsion layer of the same type of photographic material as described in (1) above with warm water e.g., at about 35° C. to about 60° C., preferably about 40° C. to about 55° C., to remove a greater portion of the silver halide and binder, exposing the material imagewise to form a light deposited silver image, and then treating the silver image with the physical developer of the invention thereby to intensify the silver image with the non-silver metal;

(5) a method which comprises washing the emulsion layer of the same type of photographic material as described in (1) above with warm water e.g., at about 35° C. to about 60° C., preferably about 40° C. to about 55° C., to remove a greater portion of the silver halide and binder, exposing the material imagewise, developing the image to form a developed silver image having a low optical density, and then treating the material with the physical developer of the invention thereby to intensify the developed silver image with the non-silver metal;

(6) a method which comprises exposing imagewise a photographic material having the same structure as in the material described in (1) above but containing a very small amount of silver halide, and then treating the material in the same manner as in (5) above;

(7) a method which comprises subjecting the same type of photographic material as described in (1) above to imagewise exposure and monobath development to develop the exposed area and remove the silver halide in the unexposed area, and then treating the material with the physical developer of this invention to intensify the developed silver image with the non-silver metal; and (8) a method which comprises using a diffusion transfer photographic material comprising a support and an image-receiving layer containing a physical development nucleus for diffusion transfer formed on the support, either directly or through at least one subbing layer, forming a transfer silver image by a diffusion transfer developing process, and then treating the transfer silver image with the physical developer solution of this invention thereby to intensify the transferred silver image with the non-silver metal.

In the above-described embodiments, the image-recorded elements obtained by the process of the invention are characterized in that they include a layer having an exposed area and an unexposed area, and the non-silver physical development in this layer is the direct and selective intensification with the non-silver metal of a silver nucleus or silver image formed by light deposition or development (or diffusion transfer) in the exposed area.

A photographic image can be formed on a photographic material by processing the photographic material in a series of conventional photographic processing steps including imagewise exposure, photographic development, fixation for removing silver halide in the unexposed area, and rinsing thereby to form a silver image of low density and contrast, and redeveloping and intensifying the silver image in a physical developer solution containing a compound of a non-silver metal.

Intensification of silver images by non-silver physical development depends on the treating temperature and time. Hence, this process has the great advantage that (1) since a known chemical development can be utilized for image formation, the process can start from silver halide photographic materials which have very high sensitivity and are sensitive to the entire visible spectral region, and (2) the efficiency of intensifying silver images by physical development is extremely high and a marked increase in optical density can be achieved. Accordingly, this process can start from a photographic material having a relatively low silver content, and enables a silver image of insufficient density to be converted to an ordinary image by non-silver physical development.

Since a non-silver metal image to be deposited on the silver image has a high degree of covering power, the amount of silver present in silver salt photographic materials used may be as low as about 0.1 μg, preferably at least 0.3 μg, especially preferably at least 5 μg, per square centimeter. No upper limit of the silver content substantially exists. It is very significant, therefore, that large quantities of silver can be saved by the present invention. If the ratio of gelatin to silver is constant, the saving of silver halide results in a saving of gelatin as well. Saving of these materials is advantageous in that the thickness of the photographic material can be reduced, and the speeds of processing and drying can be increased.

When the process of the present invention is to be applied to non-silver halide photographic materials other than silver halide photographic materials, the following typical processing methods can, for example, be employed:

(1) a method which comprises exposing imagewise a non-silver halide photographic material comprising a support and a layer of a chalcogen compound and a layer of silver thereon or a non-silver halide photographic material comprising a support and a layer of a mixture of a chalcogen compound and silver thereon using ultraviolet light or visible light, and then treating the resulting silver image with the physical developer of this invention thereby to intensify the silver image with the non-silver metal;

(2) a method which comprises exposing imagewise the same type of non-silver halide photographic material as described in (1) above using ultraviolet light or visible light, heating the exposed material to a temperature of about 50° to about 300° C., and then treating the resulting silver image with the physical developer of the invention to intensify the silver image with the non-silver metal;

(3) a method which comprises exposing imagewise the same type of non-silver halide photographic material as described in (1) above using ultraviolet light or visible light while heating it to a temperature of about 30° to about 200° C., and then treating the resulting silver image with the physical developer of the invention thereby to intensify the silver image with the non-silver metal; and (4) a method which comprises exposing imagewise the same type of non-silver halide photographic material as described in (1) above using ultraviolet light or visible light, optionally heating the material to a temperature of about 50° C. to about 300° C., treating the material with a solvent such as alkali-containing aqueous solutions or alkali-containing organic solutions, and then treating the resulting silver image with the physical developer of the invention to intensify the silver image with the non-silver metal.

Non-silver halide photographic materials of the above type are disclosed in detail in, for example, Japanese Patent Application (OPI) Nos. 17402/72, 27218/72, 25533/73, 45229/73, 77701/74 and 125803/75 and U.S. Pat. application Ser. No. 709,744, filed July 29, 1976.

The temperature at which the physical developer is used is selected depending upon the types of the components of the developer, especially the reducing agent and complexing agent. Specifically, when a borohydride compound of formula (Ic) is used as the reducing agent and an amine compound is used in combination therewith, the physical developer can be employed at a temperature of about 15° C. to about 70° C., preferably about 18° C. to about 60° C. When an amine borane compound of formula (Ia) or (Ib) is used as the reducing agent and an amine compound is used in combination therewith, the physical developer can be employed (a) at a temperature of about 18° C. to about 95° C., preferably about 23° C. to about 85° C., if the amount of the amine borane compound is at least about 100 g per liter of the developer, and (b) at a temperature of about 30° C. to about 95° C., preferably about 35° C. to about 85° C., if the amount of the amine borane compound is about 40 g per liter of the developer or less and (c) when the amine borane compound is present in an amount of about 40 g to about 100 g per liter of the developer, the lower limit of the temperature at which the physical developer can be employed decreases from about 30° C. to about 18° C., preferably from about 35° C. to about 23° C., in a substantially straight-line relationship depending on the increase in the content of the amine borane compound.

This straight-line relationship can be represented by the relationship $T=-0.2M+38$, preferably $T=-0.2M+43$ wherein $T$ is the temperature in ° C. and $M$ is the amount of the amine borane compound in grams per liter of the developer within the range from about 40 g to 100 g per liter of the developer. The upper limit of the temperature at which the physical developer solution can be employed is always nearly constant regardless of the amount of the amine borane compound.

When a mixture of a borohydride compound of formula (Ic) and an amine borane compound of formula (Ia) or (Ib) in a weight ratio (Ic)/(Ia) or (Ib) of about 3:1 or less is used as the reduction agent and an amine compound is used in combination therewith, the physical developer solution can be employed at temperatures within the same range as in the case of using the amine borane compound as the reducing agent. When a mixture of the borohydride compound and the amine borane compound in a weight ratio (Ic)/(Ia) or (Ib) of about 3:1 or higher is used as the reducing agent and the amine compound is used in combination therewith, the temperature range within which the physical developer can be employed gradually changes to the temperature range that can be employed when the borohydride compound alone is used as the reducing agent.

The process of this invention exhibits its advantages remarkably when temperatures within the above-described ranges are selected. If physical development is carried out by the process of this invention using a physical developer, which contains a borohydride compound of formula (Ic) as the reducing agent but which does not contain an amine compound, the physical developer is stable at a temperature of about 18 to about 35° C., but abruptly decomposes when the temperature exceeds about 35° C. It has also been ascertained that when this physical developer solution is used, the physical development requires a period of time more than two times as long as in the case of using the physical developer solution of this invention, and various difficulties will occur such as an insufficiency in the intensification of silver images. On the other hand, the methods disclosed in Japanese Patent Publication No. 13116/71 and U.S. Pat. No. 3,650,748 cannot be used to intensify silver images with non-silver metals. It has been confirmed that when the temperature of the physical developer solution is increased to above about 35° C. in the method disclosed in U.S. Pat. 3,650,748, silver images can be intensified with non-silver metals. In contrast, it has been found that the deposition of non-silver metals cannot be achieved with the method disclosed in Japanese Patent Publication No. 13116/71 even if the temperature of the physical developer is increased to about 85° C. to about 90° C. and physical development is performed for 15 minutes at this temperature.

In view of these findings, it is further evident that the process of the present invention which can be used to intensify a photographically obtained silver image with a non-silver metal by selecting suitable temperature conditions without any auxiliary treatment is very advantageous.

In the process of the present invention, application of the physical developer solution is most simply carried out by a method which involves immersing a photographic material having a photographically formed silver image in the physical developer, and withdrawing the material from the developer when a non-silver metal image of the desired optical density is obtained. A method comprising spraying the physical developer onto a photographic material having a silver image, and a method in which immersion into and withdrawal of the above-described photographic material from the physical developer using suitable means such as a roll or conveyor are other examples of techniques which can be used.

The time required for a sufficient deposition of a non-silver metal from the physical developer solution onto a photographic material having a silver image depends upon the composition of the physical developer used, the optical density of the image desired and the developing temperature. Generally, a suitable time ranges from about 1 second to several hours. For ease in the physical developing operation, a suitable time ranges from about 5 seconds to about 20 minutes, preferably from about 10 seconds to about 10 minutes. Since the temperature range within which the physical developer of the invention can be employed is broad, it is easy to select the temperature of the physical developer so that the deposition of a non-silver metal onto the silver image will be completed within the above-described time period. This is another advantage of the process of this invention.

The process of this invention can be applied to general negative-type and positive-type silver halide photographic materials, auto-positive photographic materials and diffusion transfer photographic materials. Suitable silver halides which can be used are, for example, silver chloride, silver bromide, silver chlorobromide, silver iodide, silver chloroiodobromide, silver iodochloride and silver iodobromide. Various known photographic emulsions can be subjected to the process of this invention. They include, for example, coarse-grain emulsions and fine-grain emulsions described in Goro Miyamoto "Photographic Materials and Methods of Handling" Lectures on Photographic Techniques, No. 2, pages 74 to 90, Kyoritsu Shuppan Co., Ltd., Tokyo (1955); the emulsions described at pages 327 to 368 of P. Glafkides, Photographic Chemistry, Vol. 1, Fountain Press, London (1960); the emulsions disclosed at page 57 to 82 of G. F. Duffin, Photographic Emulsion Chemistry, The Focal Press, London and New York (1966); and the emulsions described at pages 63–67, 125–132 and 272–288 of R. W. James, Photographic Emulsions Recent Developments, Noyes Data Corp., Park Ridge, N.J., U.S.A. and London (1973).

The amount of silver halide varies according to the purpose of use. But since silver is not used to form a final image, the silver halide photographic materials subjected to the process of this invention do not need to contain silver halide in high amounts. Sufficient amounts of silver which can be coated range from about 0.1 μg to about 1,000 μg, preferably from 1 μg to 100 μg, per square centimeter. Smaller amounts of silver are preferred, but it is also possible to employ silver halide photographic materials which contain silver halide in usual amounts.

Metal images obtained by using the physical developer solution of this invention are useful for medical and industrial radiography, the graphic arts, and portraits.

The following examples are given to illustrate the present invention in greater detail. Unless otherwise indicated herein, all parts, percents, ratios and the like are by weight.

EXAMPLE 1

A step wedge [wedge constant (step density difference); 0.15; maximum optical density 4.5] was superimposed on that surface of a motion-picture fine-grain positive film which was coated with a fine-grain silver iodobromide-gelatin emulsion (average silver halide grain size: 0.2 μm, silver iodide: 2.5 mole%, silver bromide: 97.5 mole%, coating amount: about 3 g/m$^2$ as silver), and a Fuji Exposure Lamp (20 V, 30 W tungsten-filament incandescent lamp, made by Fuji Photo Film Co., Ltd.) as a light source was lighted as 18 V. The film was thus exposed for 1 second while keeping the distance between the light source and the film at 1 meter. The exposed film was developed with a chemical developer solution of the following formulation at 20° C. for 1.5 minutes, briefly washed with water, and then immersed in a fixation bath of the following formulation at 20° C. for 3 minutes to dissolve the silver halide in the unexposed area and thus fix the image.

| Formulation of the Chemical Developer Solution | |
|---|---|
| Monomethyl p-Aminophenol Sulfate | 1 g |
| Sodium Sulfite (anhydrous) | 28 g |
| Hydroquinone | 8 g |
| Sodium Carbonate (monohydrate) | 24 g |
| Potassium Bromide | 2 g |
| Water to make | 1 liter |

| Formulation of the Fixation Bath | |
|---|---|
| Sodium Thiosulfate | 200 g |
| Sodium Hydrogen Sulfite | 25 g |
| Water to make | 1 liter |

The film was washed with water for 5 minutes and allowed to dry naturally to afford a strip having a developed silver image.

Then, while increasing the temperature of a nickel-containing Physical Developer Solution (1) of the following formulation gradually, the strip obtained was immersed in Physical Developer Solution (1) for 2 minutes.

| Formulation of the Nickel Physical Developer Solution (1) | |
|---|---|
| Water | 500 ml |
| Nickel (II) Chlrode (hexahydrate) | 24 g |
| Gluconic Acid (about 50% by weight aqueous solution) | 240 g |
| Dimethylamine Borane [$(CH_3)_2NHBH_3$] | 12 g |
| Monoethanolamine | 61 ml |
| Additional Water to make | 1 liter |

| Time from Beginning of Physical Development | Temperature of Physical Developer Solution (°C.) |
|---|---|
| 0 | 35 |
| 30 sec. | 45 |
| 1 min. | 52 |
| 1 min. and 30 sec. | 60 |
| 2 min. | 66 |

Finally, the strip was washed with water and allowed to dry naturally. Nickel deposited on, and intensified, the silver image on the strip.

The results obtained are plotted in FIG. 1. Curve Ag refers to the curve of the silver image which was not subjected to physical development, and Curve 1–2 is the curve of the image after physical development.

Comparative Example 1

Using the same photographic material as used in Example 1, the procedure of Example 1 was repeated except that Physical Developer Solution (C1) [corresponding to Physical Developer Solution (1) but excluding the monoethanolamine] was used, and while gradually increasing the temperature of the developer solution, the photographic material was treated for 2 minutes and 5 minutes, respectively.

| Nickel Physical Developer Solution (Cl) | |
|---|---|
| Water | 500 ml |
| Nickel (II) Chloride (hexahydrate) | 24 g |
| Gluconic Acid (about 50% by weight aqueous solution) | 240 g |
| Dimethylamine Borane [$(CH_3)_2HNBH_3$] | 12 g |
| Sodium Hydroxide to adjust pH to | 9.5 |
| Additional Water to make | 1 liter |

| Time from Beginning of Physical Development | Temperature of Physical Developer Solution (°C.) |
|---|---|
| 0 | 35 |
| 30 sec. | 45 |
| 1 min. | 53 |
| 1 min. and 30 sec. | 62 |
| 2 min. | 68 |
| 2 min. and 30 sec. | 73 |
| 3 min. | 78 |
| 4 min. | 82 |
| 5 min. | 85 |

Nickel did not deposit on the silver image in the strip, and the silver image was not intensified. The results obtained are shown by Curve C1-2 (physical development performed for 2 minutes) and Curve C1-5 (physical development performed for 5 minutes) of FIG. 1.

Comparative Example 2

The procedure of Example 1 was repeated except that the photographic material was treated for 2 minutes using a nickel Physical Developer Solution (C2) of the following formulation.

| Nickel Physical Developer Solution (C2) | |
|---|---|
| Water | 500 ml |
| Nickel (II) Chloride (hexahydrate) | 24 g |
| Gluconic Acid (about 50% by weight aqueous solution) | 240 g |
| tert-Butylamine Borane ($t\text{-}BuNH_2BH_3$) | 12 g |
| Sodium Hydroxide added to adjust pH to | 9.5 |
| Additional Water to make | 1 liter |

No nickel deposited on the silver image. The results are shown by Curve C2-2 of FIG. 2. It is clear from the figure that the density of the silver image rather decreased.

EXAMPLE 2

The procedure of Example 1 was repeated except that a nickel Physical Developer Solution (2) obtained by excluding sodium hydroxide from the Physical Developer Solution (C2) used in Comparative Example 2 but adding 61 ml of monoethanolamine was used, and the photographic material was treated with this solution for 2 minutes. Nickel deposited on the silver image of the strip and intensified the image quite advantageously.

Figure 2:
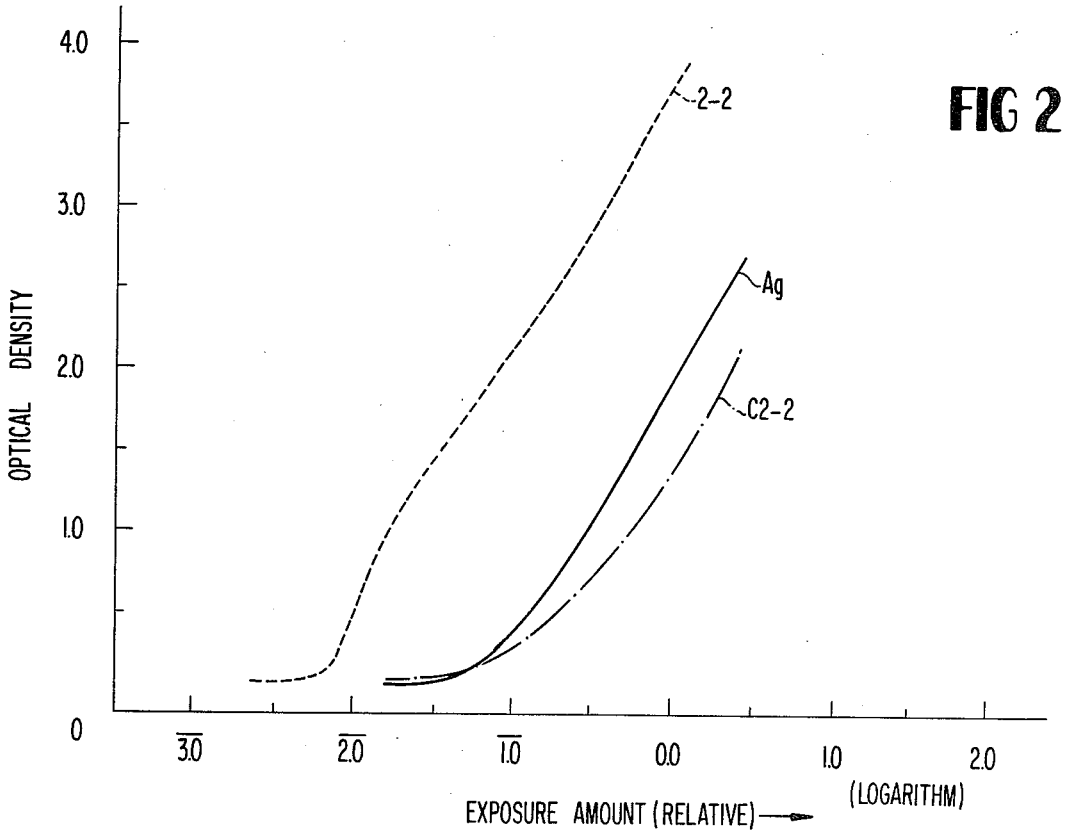
FIG. 2 shows sensitometric curves of images obtained in Example 2 and Comparative Example 2.

The results obtained are shown by Curve 2—2 in FIG. 2. Curve Ag in FIG. 2 is a curve of the silver image which was not subjected to the physical development.

It is clear from the results obtained in Examples 1 and 2 that the intensification of the silver image by physical development using nickel does not depend upon the reducing agent used.

EXAMPLE 3

The procedure of Example 1 was repeated except that the photographic material was treated with each of the Physical Developer Solutions (301) to (353) shown below while gradually increasing the temperature of the developer solution from 35° C. to about 85° C. over the course of 5 minutes.

| Nickel Physical Developer Solutions (301) to (353) | |
|---|---|
| Water | 500 ml |
| Nickel (II) Chloride (hexahydrate) | 24 g |
| Gluconic Acid (about 50% by weight aqueous solution) | 240 g |
| Dimethylamine Borane | 12 g |
| Amine compound or ammonium compound (See table below) | amount as indicated in table below |
| Sodium Hydroxide | to adjust pH as shown in table below |
| Additional Water to make | 1 liter |

Some amine or ammonium compounds did not completely dissolve upon addition. In such a case, the physical developer solutions were used containing undissolved material. The sodium hydroxide was added to the physical developer solutions immediately before adding the additional water to make 1 liter.

| Physical Developer Solution | Amine Compound or Ammonium Compound | Amount (g) | pH |
|---|---|---|---|
| (301) | None | — | 9.0 |
| (302) | Methylamine | 31 | 9.4 |
| (303) | Ethylamine | 45 | 9.3 |
| (304) | Propylamine | 59 | 9.3 |
| (305) | Isopropylamine | 59 | 9.3 |
| (306) | Butylamine | 73 | 9.0 |
| (307) | tert-Butylamine | 73 | 9.8 |
| (308) | Amylamine | 87 | 9.4 |
| (309) | Hexylamine | 101 | 9.5 |
| (310) | Dimethylamine | 45 | 9.0 |
| (311) | Diethylamine | 73 | 9.7 |
| (312) | sec-Butylamine | 73 | 9.0 |
| (313) | iso-Butylamine | 73 | 9.3 |
| (314) | Dipropylamine | 101 | 9.2 |
| (315) | Diisopropanolamine | 133 | 9.0 |
| (316) | Triisopropanolamine | 191 | 9.2 |
| (317) | Monoethanolamine | 61 | 9.0 |
| (318) | Diethanolamine | 105 | 9.1 |
| (319) | Triethanolamine | 149 | 9.2 |
| (320) | N-Methyl ethanolamine | 75 | 9.2 |
| (321) | N,N-Diethylaminoethanol | 117 | 9.2 |
| (322) | Isopropanolamine | 75 | 9.1 |
| (323) | 2-Amino-2-methyl-1,3-propanediol | 105 | 8.9 |
| (324) | 2-Amino-2-ethyl-1,3-propanediol | 119 | 9.0 |
| (325) | 2-Amino-2-hydroxymethyl-1,3-propanediol | 121 | 9.3 |
| (326) | Ethylenediamine | 60 | 12.5 |
| (327) | Trimethylenediamine | 74 | 12.4 |
| (328) | Propylenediamine | 74 | 12.4 |
| (329) | Tetramethylenediamine | 88 | 12.3 |
| (330) | Pentamethylenediamine | 102 | 12.2 |
| (331) | Hexamethylenediamine | 116 | 11.0 |
| (332) | N-(2-Hydroxyethyl)ethylenediamine | 104 | 12.5 |
| (333) | N,N'-Dimethylethylenediamine | 88 | 12.7 |
| (334) | N,N,N',N'-Tetramethylethylenediamine | 116 | 12.4 |
| (335) | Triethylenetetramine | 146 | 12.4 |
| (336) | Dicyclohexylamine | 325 | 9.3 |
| (337) | Glycine | 75 | 9.0 |
| (338) | Morpholine | 87 | 9.0 |
| (339) | 2-Pyrrolidone | 85 | 9.9 |
| (340) | N-Methyl-2-pyrrolidone | 99 | 10.0 |
| (341) | Imidazole | 68 | 11.2 |
| (342) | 2-Methylimidazole | 82 | 11.3 |
| (343) | N-Methylimidazole | 82 | 11.0 |
| (344) | Ethyleneurea | 86 | 9.0 |

-continued

| Physical Developer Solution | Amine Compound or Ammonium Compound | Amount (g) | pH |
|---|---|---|---|
| (345) | Hydrazine hydrate | 50 | 12.9 |
| (346) | Aqueous Ammonia (28 %) | 60 | 9.0 |
| (347) | Ammonium chloride | 54 | 9.0 |
| (348) | Ammonium bromide | 98 | 9.5 |
| (349) | Ammonium nitrate | 80 | 10.9 |
| (350) | Ammonium sulfate | 132 | 10.8 |
| (351) | Ammonium phosphate trihydrate | 203 | 10.3 |
| (352) | Ammonium oxalate monohydrate | 142 | 10.7 |
| (353) | Diammonium hydrogen citrate | 226 | 10.6 |

Figure 3:
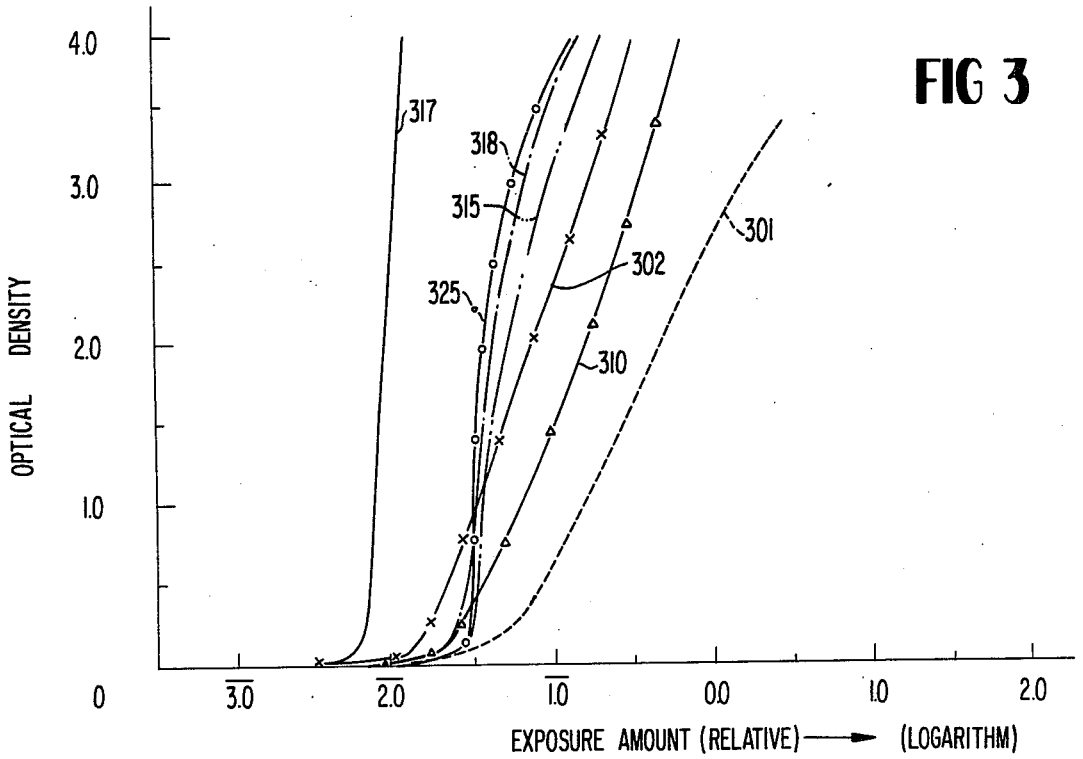
FIGS. 3 and 4 show sensitometric curves of images obtained in Example 3.
Figure 4:
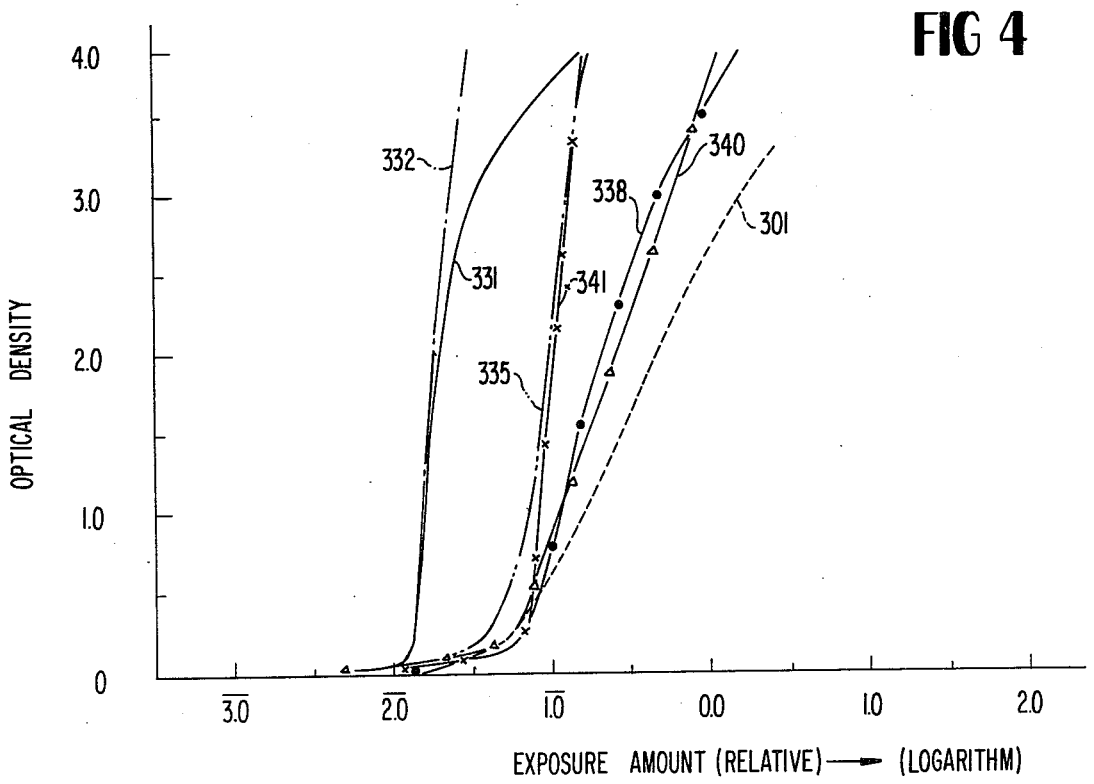

It was found that nickel deposited on, and intensified, the silver images of the strips treated with the nickel Physical Developer Solutions (302) to (353). However, nickel did not deposit on the silver image of the strip treated with Physical Developer Solution (301) (control). The results obtained for some representative physical developer solutions are plotted in FIGS. 3 and 4. The numbers of the curves refer to the images intensified by treatment with the physical developer solutions having the corresponding numbers. Similar results were obtained with the strips treated with other amine or ammonium compounds specified in the present invention but not shown in these figures.

EXAMPLE 4

The procedure of Example 1 was repeated except that the photographic material was treated with Physical Developer Solution (4) of the following formulation at 40° C. for 1.5 minutes.

| Nickel Physical Developer Solution (4) | |
|---|---|
| Nickel Sulfate | 2 g |
| Potassium Sodium Tartrate | 4 g |
| Trimethylenediamine | 7.1 ml |
| Sodium Borohydride ($NaBH_4$) | 2.5 g |
| Water | 100 ml |

Nickel deposited on, and intensified, the silver image on the strip.

Figure 5:
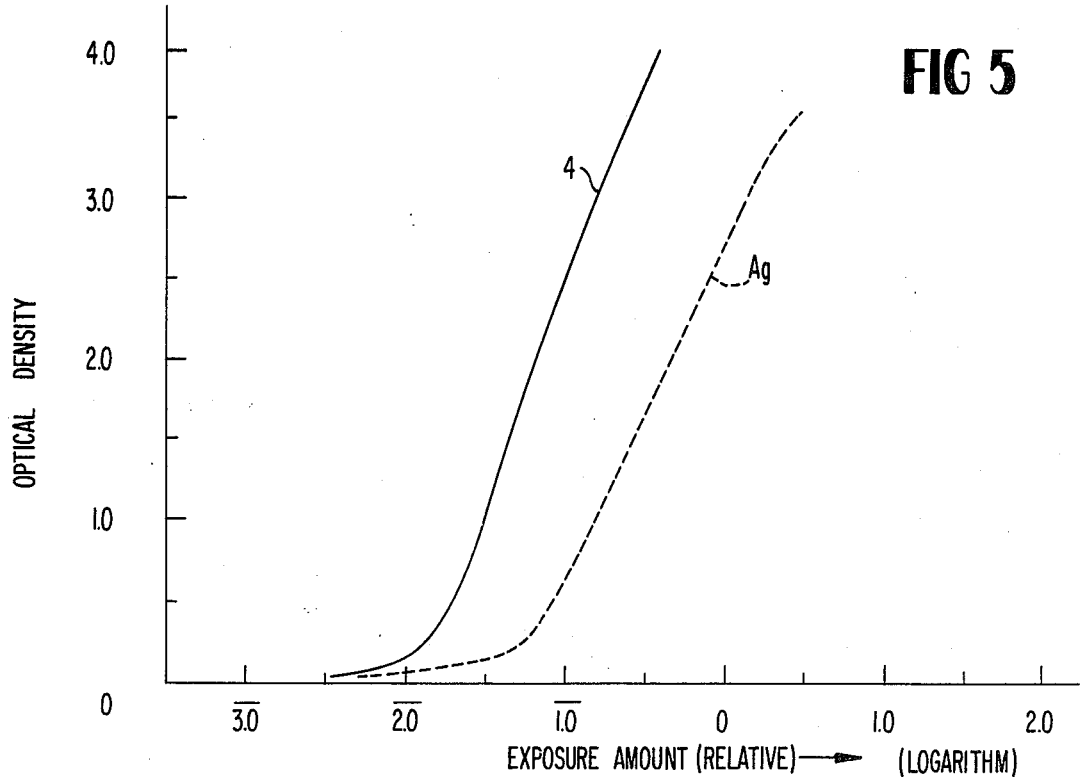
FIG. 5 shows sensitometric curves of images obtained in Example 5.

The results obtained are plotted in Curve (4) of FIG. 5. Curve Ag in FIG. 5 refers to the silver image which was not intensified. It can be seen from the figure that the intensified image showed a superior reproduction of continuous gradation.

EXAMPLE 5

The procedure of Example 3 was repeated using Physical Developer Solution (502)–(553) having the same composition as the nickel Physical Developer Solutions (302) to (353) used in Example 3 except that the solution contained 12 g of tert-butylamine borane as the reducing agent. The same results as in Example 3 were obtained.

EXAMPLE 6

The procedure of Example 1 was repeated except that each of the following physical developer solutions was used, and the effect of pH was examined.

| Nickel Physical Developer Solutions (61) to (67) | |
|---|---|
| Water | 80 ml |
| Nickel (II) Chloride (hexahydrate) | 2.4 g |
| Gluconic Acid (about 50% by weight aqueous solution) | 24 g |
| Ammonium Chloride | 5.3 g |

Sodium hydroxide was added to each of the above solutions to adjust the pH of the solution as shown below, and then 1.2 g of dimethylamine borane was added.

| Physical Developer Solution No. | pH |
|---|---|
| (61) | 4 |
| (62) | 7 |
| (63) | 7.5 |
| (64) | 8 |
| (65) | 9 |
| (66) | 10.5 |
| (67) | 12.5 |

The silver image could not be intensified with Physical Developer Solutions (61), (62) and (63). With Physical Developer Solution (65), nickel deposited on, and intensified, the silver image. Specifically, those portions of the silver image which had an optical density of 0.16 and 0.25, respectively, attained an optical density of 1.9 and 4 or more, respectively, as a result of the treatment. With Physical Developer Solutions (65), (66) and (67), the maximum optical density of the intensified image was more than 4.

EXAMPLE 7

The procedure of Example 1 was repeated except that Physical Developer Solution (7) having the following formulation was used.

| Nickel Physical Developer Solution (7) | |
|---|---|
| Nickel (II) Chloride (hexahydrate) | 4 g |
| Lactic Acid | 4 ml |
| Water | 100 ml |

Aqueous ammonia (28% by weight) was added to adjust the pH of the solution to 6.4, and then 2 g of dimethylamine borane was added.

Nickel deposited on, and intensified quite well, the silver image on the strip.

EXAMPLE 8

The procedure of Example 1 was repeated except that each of the following Physical Developer Solutions (8A), (8B), (8C) and (8D) was used.

| | Nickel Physical Developer Solution | | | |
|---|---|---|---|---|
| Composition | (8A) | (8B) | (8C) | (8D) |
| Nickel (II) Chloride (hexahydrate) | 2.4 g | 2.4 g | 2.4 g | 2.4 g |
| Gluconic Acid (about 50% by weight aqueous soluton) | 24 ml | 24 ml | 24 ml | 24 ml |
| Monoethanolamine | — | 0.05 ml | 0.1 ml | 0.2 ml |
| Water | 80 ml | 80 ml | 80 ml | 80 ml |
| Sodium Hydroxide added to adjust the pH to 10.5 and then Dimethylamine Borane | | | | |

-continued

| Composition | Nickel Physical Developer Solution (8A) | (8B) | (8C) | (8D) |
|---|---|---|---|---|
| added | 1.2 g | 1.2 g | 1.2 g | 1.2 g |

Figure 6:
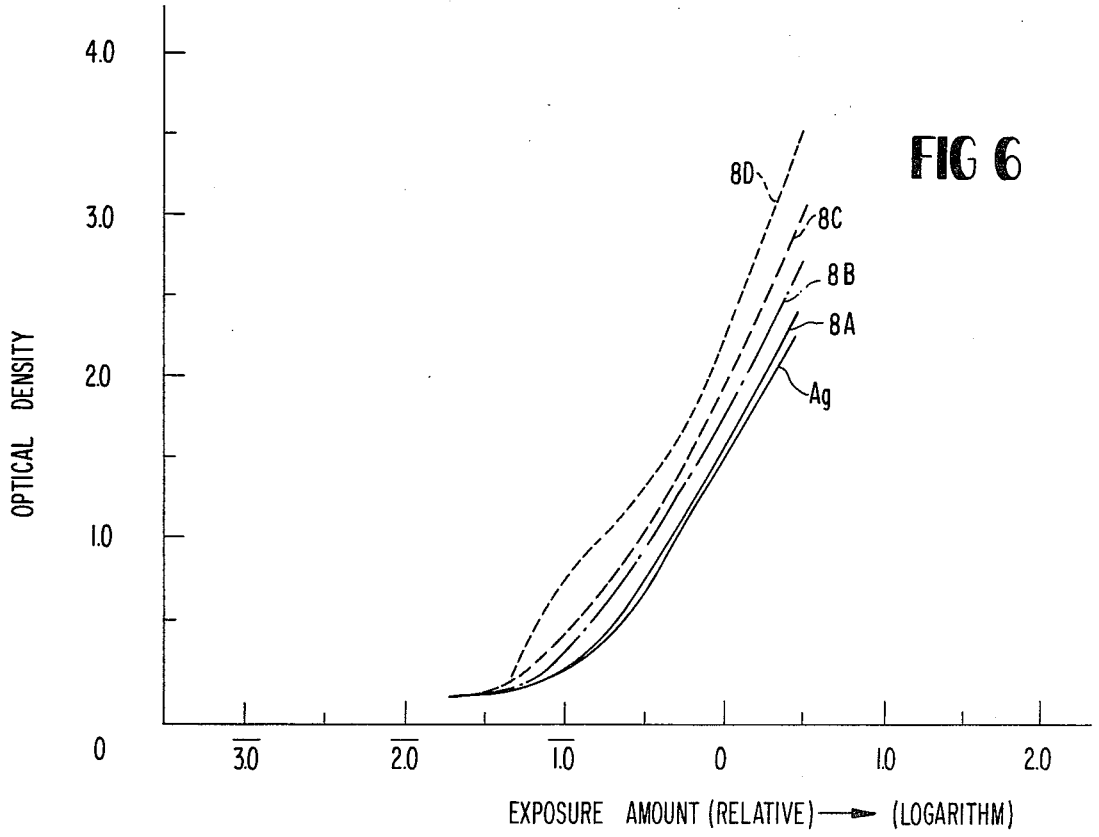
FIGS. 6 to 8 show sensitometric curves of images obtained in Examples 8 to 10, respectively.

Nickel deposited on, and intensified, the silver images on the strips treated with Physical Developer Solution (8B), (8C) and (8D). The silver image treated with Physical Developer Solution (8A) was scarcely intensified. The results are plotted in FIG. 6. Curve Ag in the figure refers to the silver image which was not subjected to physical development. Curves having the other indications refer to the images intensified by treatment with the corresponding physical developer solutions. It is clear from the figure that the effect of intensification increases as the amount of monoethanolamine in the physical developer is increased.

EXAMPLE 9

The procedure of Example 1 was repeated except that each of the following Physical Developer Solutions (9A), (9B), (9C) and (9D) was used, and the temperature of the solution was gradually increased from 35° C. to 95° C. over the course of 5 minutes.

| Component | Nickel Physical Developer Solution (9A) | (9B) | (9C) | (9D) |
|---|---|---|---|---|
| Nickel (II) Chloride (hexahydrate) | 2.4 g | 2.4 g | 2.4 g | 2.4 g |
| Water | — | 5 ml | 10 ml | 20 ml |
| Monoethanolamine | 80 ml | 80 ml | 80 ml | 80 ml |
| Lactic Acid added to adjust the pH to 10.5, and then Dimethylamine Borane added | 1.2 g | 1.2 g | 1.2 g | 1.2 g |

Figure 7:
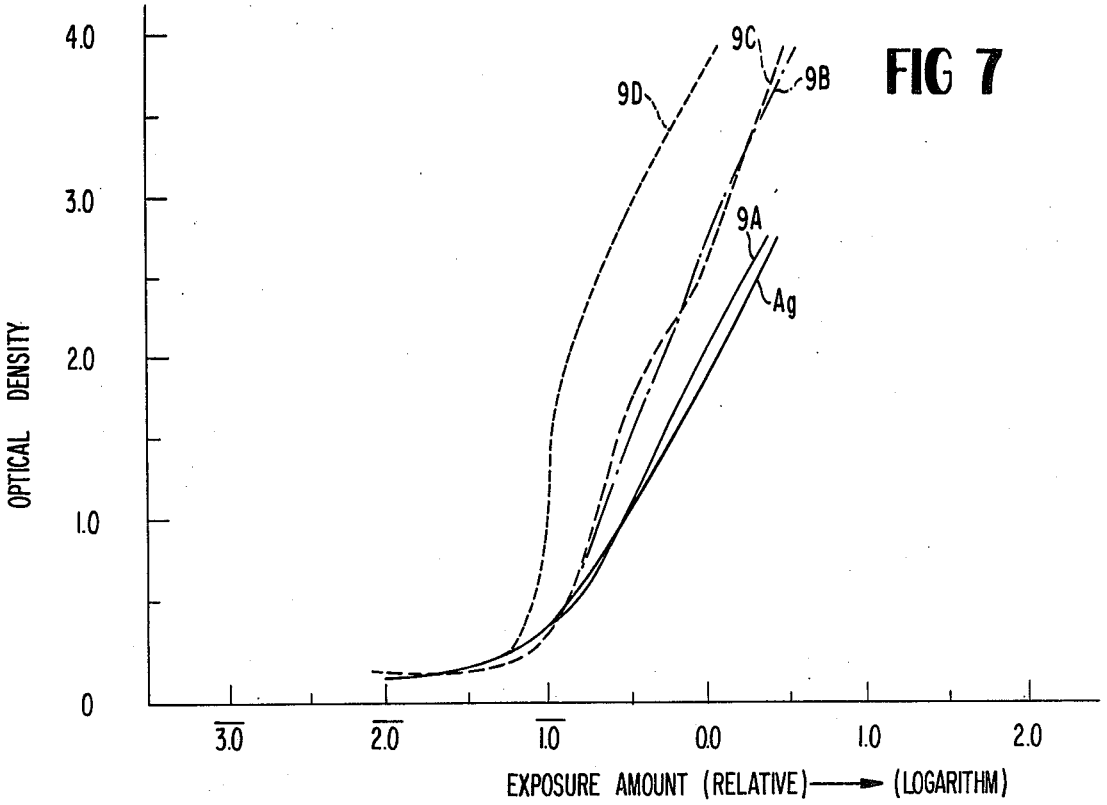

It was found that nickel deposited on, and intensified, the silver images on the strips treated with the Physical Developer Solutions (9B), (9C) and (9D). The silver image on the strip treated with Physical Developer Solution No. (9A) was scarcely intensified, and only that portion of the silver image which had a high optical density was slightly intensified. The results are plotted in FIG. 7. Curve Ag in the figure refers to the silver image which was not subjected to physical development. Curves marked otherwise refer to the images intensified by treatment with the corresponding physical developer solutions. It can be seen from the figure that in the silver image treated with Physical Developer Solution (9A), only that portion of the silver image which had an optical density of more than about 1 was slightly intensified. It can also be seen from FIG. 7 that the inclusion of water in the physical developer is essential, and there is substantially no upper limit to the amount of monoethanolamine which can be used.

EXAMPLE 10

The procedure of Example 1 was repeated except that the following physical developer solutions were used, and the treatment was performed while gradually increasing the temperature of the developer within the temperature range indicated for the periods indicated.

| Component | Nickel Physical Developer Solution (10A) | (10B) | (10C) | (10D) |
|---|---|---|---|---|
| Nickel (II) Chloride (hexahydrate) | 2.4 g | 2.4 g | 2.4 g | 2.4 g |
| Trimethylenediamine | — | 3 ml | — | — |
| Monoethanolamine | — | — | 6.1 ml | — |
| Ammonium Chloride | — | — | — | 5.3 g |
| Dimethylamine Borane | 1.2 g | 1.2 g | 1.2 g | 1.2 g |
| Water | 100 ml | 100 ml | 100 ml | 100 ml |
| pH | 9.1 | 11.1 | 11.1 | 9.1 |

Note: In Physical Developer Solutions(10A) and (10D), the pH was adjusted by adding sodium hydroxide.

The treating times and treating temperatures (temperatures at the beginning and end) were adjusted as follows:

| | Physical Developer Solution (10A) | (10B) | (10C) | (10D) |
|---|---|---|---|---|
| Treating Time (minutes) | 4 | 2 | 2 | 3 |
| Treating Temperature (°C.) | | | | |
| Beginning | 25 | 20 | 25 | 25 |
| End | 75 | 50 | 50 | 50 |

It was found that nickel deposited on, and intensified, the silver images on the strips treated with Physical Developer Solutions (10B), (10C) and (10D). However, the silver image on the strip treated with Physical Developer Solution (10A) was scarcely intensified. Physical Developer Solution (10A) had poor stability, and began to decompose during treatment.

Figure 8:
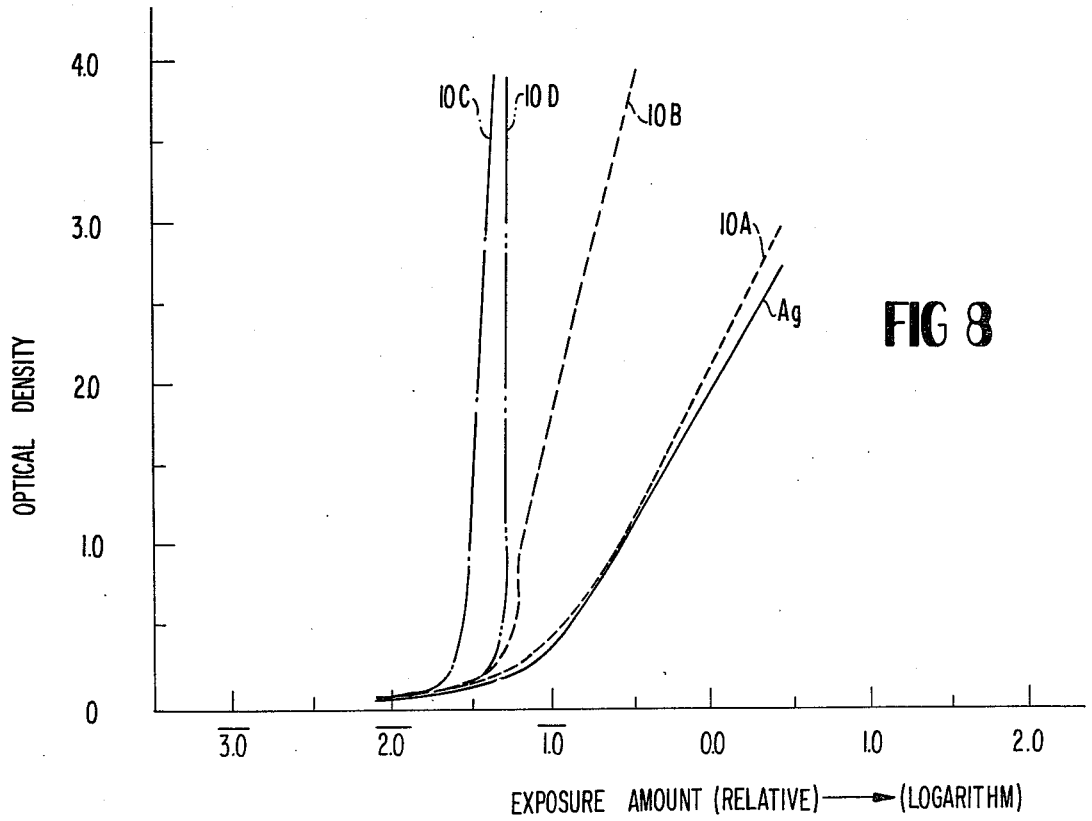

The results are plotted in FIG. 8. Curve Ag refers to the silver image which was not subjected to physical development. Curves marked otherwise refer to the images intensified by treatment with the corresponding physical developer solutions.

EXAMPLE 11

The procedure of Example 10 was repeated except that 0.8 g of sodium borohydride was used instead of the dimethylamine borane in each of the physical developer solutions. It was found that nickel deposited on, and intensified, the silver images treated with the physical developers containing an amine compound or an ammonium compound. The physical developer solution containing neither an amine compound nor an ammonium compound rapidly decomposed during preparation, and could not be used to intensify the silver image.

EXAMPLE 12

The same type of photographic material as described in Example 1 was fixed at 20° C. for 10 minutes with a 20% by weight aqueous solution of sodium thiosulfate (pentahydrate) without exposure. It was then washed with water for 5 minutes, and dried to form a transparent film. An image-bearing transparency was superimposed on the resulting film, and in the same manner as in Example 1, the film was exposed imagewise for 10 minutes. The exposed film was then treated with Physical Developer Solution (12) of the following formulation for 2 minutes and 30 seconds while increasing the temperature of the solution from 25° C. to 65° C.

| Formulation of the Nickel Physical Developer Solution (12) | |
|---|---|
| Nickel (II) Sulfate (heptahydrate) | 2 g |
| Trimethylenediamine | 7.4 ml |
| Sodium Borohydride | 2 g |
| Water | 100 ml |

No change occurred in the appearance of the transparent film as a result of the imagewise exposure. However, the physical development caused the blackening of the exposed area, and a positive image was obtained. The transparent film after fixation was analyzed for silver, and it was found that silver was present in an amount of 0.35 $\mu g/cm^2$. The results of this Example demonstrate that a latent image formed on a photographic material having a silver content of not more than 0.35 $\mu g/cm^2$ can also be intensified by the process of this invention.

EXAMPLE 13

A 0.18 mm thick subbing-coated polyethylene terephthalate film was coated with an antihalation layer on one surface and with an aqueous gelatin solution containing a nuclei for physical development on the other. The aqueous gelatin solution had the formulation shown below.

| Formulation of the Aqueous Gelatin Solution | |
|---|---|
| Aqueous Dispersion of Nickel Sulfide/Gelatin (containing $5 \times 10^{-4}$% by weight of nickel sulfide and 0.5% by weight of gelatin) | 0.6 g |
| Gelatin | 0.6 g |
| Water | 100 ml |
| Mucochloric Acid (2% by weight aqueous solution) | 2 ml |
| Glycerin | 0.2 g |

The coated film was dried at 40° C. for 10 minutes to form a diffusion transfer image receiving layer having a thickness of 1.0 $\mu m$ (dry thickness).

An emulsion composition of the following formulation was coated on the image-receiving layer so that the dry thickness of the composition would be 1.5 $\mu m$. Thus, a multilayered diffusion transfer photographic material was produced.

| Formulation of the Emulsion Composition | |
|---|---|
| Raw Emulsion | 50 g |
| Gelatin | 17 g |
| Sodium Alkylbenzenesulfonate (1% by weight aqueous solution) | 17 ml |
| 4-Hydroxy-6-methyl-1,3,3a,7-tetraazaindene (0.5% by weight aqueous solution) | 25 ml |

The raw emulsion was a high contrast lithographic gelatino-silver chlorobromide emulsion containing 70 mole% of silver chloride with a silver content of 1 mole per kilogram of the emulsion. The average silver halide grain size was 0.3 $\mu m$.

A step wedge [wedge constant (step density difference) 0.15, maximum optical density 4.5] was superimposed on the photographic material obtained, and a tungsten-filament incandescent lamp (rating 20 V, 30 W) was lighted at 18 V. The photographic material was thus exposed for 2 seconds while maintaining the distance between the light source and the photographic material at 60 cm. The exposed material was developed at 20° C. for 45 seconds with a diffusion transfer developer of the following formulation, and then immersed in warm water held at 50° C. to soften the negative emulsion layer and remove it. Otherwise, the photographic material was treated in the same manner as in Example 3.

| Formulation of the Diffusion Transfer Developer | |
|---|---|
| Water | 500 ml |
| 1-Phenyl-3-pyrazolidone | 1 g |
| Sodium Sulfite (anhydrous) | 60 g |
| Hydroquinone | 15 g |
| Sodium Hydroxide | 20 g |
| Sodium Thiosulfate (pentahydrate) | 10 g |
| Potassium Bromide | 1 g |
| Additional Water to make | 2 liter |

It was found that nickel deposited on, and intensified, the silver image on the image-receiving layer, and the results were much the same as in Example 3.

EXAMPLE 14

The procedure of Example 1 was repeated except that the photographic material was exposed imagewise through an image-bearing negative superimposed on the photographic material, and the silver image was treated with each of the following Physical Developer Solutions at 24° C. for 15 minutes.

| | Nickel Physical Developer Solution | | |
|---|---|---|---|
| Component | (14A) | (14B) | (14C) |
| Water | 500 ml | 500 ml | 500 ml |
| Nickel (II) Sulfate (heptahydrate) | 20 g | 20 g | 20 g |
| Potassium Sodium Tartrate | 40 g | 40 g | 40 g |
| Monoethanolamine | 100 ml | 100 ml | 100 ml |
| Sodium Borohydride | 11.5 ml | 11.5 ml | 11.5 ml |
| pH | 6.0 | 11.5 | 13.2 |
| pH Adjuster | Lactic acid | None | Sodium hydroxide |
| Additional Water to make | 1 liter | 1 liter | 1 liter |

As a result of treatment with any of these physical developer solutions, nickel deposited on, and intensified, the silver image, and continuous gradation was reproduced quite well.

EXAMPLE 15

A motion-picture fine-grain positive film coated with a fine-grain silver iodobromide-gelatin emulsion (average silver halide grain size; 0.2 $\mu m$, silver iodide; 2.5 mole%, silver bromide; 97.5 mole%; coating amount; about 3 $g/m^2$ as silver) was used, and through a step wedge [wedge constant (step density difference); 0.15, maximum optical density; 4.5], the same light source as used in Example 1 was lighted at 18 V, and the film was exposed for 1 second, followed by chemical development, fixation and rinsing with water. Then, the film was treated at 50° C. for 5 minutes using Physical Developer Solution (15) of the following formulation. Otherwise, the same procedures as in Example 1 were employed.

| Nickel Physical Developer Solution (15) | |
|---|---|
| Water | 100 ml |
| Nickel (II) Sulfate (heptahydrate) | 0.4 g |
| Nickel (II) Chloride (hexahydrate) | 0.2 g |
| Ethylenediamine | 0.45 ml |
| Lactic Acid | 0.4 ml |
| Sodium Hydroxide | 0.4 g |
| Dimethylamine Borane | 0.6 g |
| Sodium Borohydride | 0.01 g |

Nickel deposited on the developed silver in the exposed area, and a negative image having a quite well reproduced continuous gradation was obtained.

EXAMPLE 16

The procedure of Example 1 was repeated except that the silver image was developed for 4 minutes at 70° C. using Physical Developer Solution (16) having the following formulation.

| Formulation of Cobalt Physical Developer Solution (16) | |
|---|---|
| Water | 500 ml |
| Hexamminecoblat (III) Chloride ($[Co(NH_3)_6]Cl_3$) | 27 g |
| Gluconic Acid (about 50% by weight aqueous solution) | 240 g |
| Monoethanolamine | 183 g |
| Dimethylamine Borane | 12 g |
| Additional Water to make | 1 liter |
| pH | 12.5 |
| Note: The pH was adjusted by adding sodium hydroride. | |

Cobalt deposited on the developed silver image in the exposed area, and a negative image was obtained.

EXAMPLE 17

The procedure of Example 1 was repeated except that the silver image was developed for 2 minutes and 30 seconds at 50° C. using Physical Developer Solution (17) of the following formulation.

| Formulation of Iron Physical Developer Solution (17) | |
|---|---|
| Water | 500 ml |
| Iron (II) Sulfate (heptahydrate) | 28 g |
| Potassium Sodium Tartrate | 15 g |
| Sodium Borohydride | 20 g |
| Monoethanolamine | 183 g |
| Additional Water to make | 1 liter |

Iron deposited on the developed silver in the exposed area, and a negative image was obtained.

EXAMPLE 18

The procedure of Example 1 was repeated except that the silver image was developed for 1 minute and 30 seconds at 50° C. using Physical Developer Solution (18) of the following formulation.

| Formulation of Copper Developer Solution (18) | |
|---|---|
| Water | 500 ml |
| Copper (II) Sulfate (pentahydrate) | 25 g |
| Gluconic Acid (about 50% by weight aqueous solution) | 240 g |
| Monoethanolamine | 183 g |
| Dimethylamine Borane | 12 g |
| Additional Water to make | 1 liter |

Copper deposited on the developed silver in the exposed area, and a negative image was obtained.

EXAMPLE 19

The procedure of Example 1 was repeated except that the silver image was treated with Physical Developer Solution (19) at 25° C. for 5 minutes.

| Formulation of Nickel Physical Developer Solution (19) | |
|---|---|
| Water | 80 ml |
| Nickel (II) Chloride (hexahydrate) | 2.4 g |
| Dimethylamine Borane | 12 g |
| Aqueous Ammonia (28% by weight) | 10 ml |
| Gluconic Acid (about 50% by weight aqueous solution) | 24 ml |
| pH | 9.5 |

Nickel deposited on, and intensified, the silver image.

EXAMPLE 20

The procedure of Example 1 was repeated except that the silver image was treated with Physical Developer Solution (20) of the following formulation at 25° C. for 5 minutes.

| Formulation of Nickel Physical Developer Solution (20) | |
|---|---|
| Water | 80 ml |
| Nickel (II) Chloride (hexahydrate) | 2 .4 g |
| Dimethylamine Borane | 12 g |
| Aqueous Ammonia (28% by weight) | 10 ml |
| Gluconic Acid (about 50% by weight aqueous solution) | 24 ml |

Sodium hydroxide was added to adjust the pH to 12.6. It was found that nickel deposited on, and intensified, the silver image.

EXAMPLE 21

The procedure of Example 1 was repeated except that the silver image was treated with Physical Developer Solution (21) of the following formulation at 25° C. for 5 minutes.

| Formulation of Nickel Physical Developer Solution (21) | |
|---|---|
| Water | 80 ml |
| Nickel (II) Chloride (hexahydrate) | 2.4 g |
| Dimethylamine Borane | 12 g |
| Aqueous Ammonia (28% by weight) | 10 ml |

Sodium hydroxide was added to adjust the pH of the solution to 12.0. It was found that nickel deposited on, and markedly intensified, the silver image.

EXAMPLE 22

The procedure of Example 1 was repeated except that the silver image was treated with Physical Developer Solution (22) of the following formulation at 25° C. for 5 minutes.

| Formulation of Nickel Physical Developer Solution (22) | |
|---|---|
| Water | 80 ml |
| Nickel (II) Chloride (hexahydrate) | 2.4 g |
| Dimethylamine Borane | 12 g |
| Monoethanolamine | 20 ml |
| Gluconic Acid (about 50% by weight | |

-continued

| Formulation of Nickel Physical Developer Solution (22) | |
|---|---|
| aqueous solution) to adjust the pH to | 10.0 |

It was found that nickel deposited on, and intensified, the silver image.

COMPARATIVE EXAMPLE 3

The procedure of Example 1 was repeated except that the silver image was treated with Physical Developer Solution (C3) of the following formulation at 25° C. for 5 minutes.

| Formulation of Nickel Physical Developer Solution (C3) | |
|---|---|
| Water | 80 ml |
| Nickel (II) Chloride (hexahydrate) | 2.4 g |
| Dimethylamine Borane | 12 g |
| Sodium Hydroxide added to adjust the pH to | 8.0 |

Nickel did not deposit on the silver image, and therefore did not intensify the silver image.

EXAMPLE 23

Both surfaces of a 0.18 mm-thick polyethylene terephthalate film were irradiated with ultraviolet light at 120° C. for 1 minute in air using a 1 KW quartz mercury lamp. Immediately then, a dispersion of gelatin in an organic solvent (subbing layer solution) of the following formulation was coated on the film, and dried at 120° C. for 5 minutes to form a subbing layer.

| Formulation of Subbing layer Solution | |
|---|---|
| Gelatin | 10 g |
| Water | 10 g |
| Acetic Acid | 10 g |
| Methanol | 200 g |
| Acetone | 600 g |
| Methylene Chloride | 100 g |
| Tetrachloroethane | 50 g |
| Phenol | 50 g |

Then, a known antihalation layer was coated on the subbing layer on one surface, and a high contrast emulsion prepared from a high contrast lithographic gelatino-silver chlorobromide raw emulsion of the following formulation was coated on the subbing layer on the other surface so that the thickness of the coated layer after drying would be 1.2 μm, and then dried.

| Formulation of the Raw Emulsion | |
|---|---|
| Silver Chloride | 70 mole % |
| Silver Bromide | 30 mole % |

Average grain size of the silver chlorobroamide 0.3 μm
Amount of silver: 1 mole per kilogram of emulsion

| Formulation of the High Contrast Emulsion | |
|---|---|
| Raw Emulsion | 50 g |
| Gelatin | 75 g |
| Water | 1500 g |
| Mucochloric Acid (2% by weight aqueous solution) | 90 ml |
| Sodium Alkylbenzenesulfonate (1% by weight aqueous solution) | 60 ml |
| Sodium Carbonate (5% by weight aqueous solution) | 18 ml |

-continued

A 1% by weight aqueous solution of gelatin was coated as a protective layer on the emulsion layer so that the thickness of the protective layer after drying would be 0.5 μm. The resulting photographic material containing 10 μg of silver per $cm^2$ of the photographic material. The amount of silver was about 1/50 as small as that of an ordinary lithographic high contrast photographic material of this type.

The resulting photographic material was exposed for 1 second through a letter-bearing negative using a Fuji Exposure Lamp (a tungsten-filament incandescent lamp 20 V 30 W, made by Fuji Photo Film Co., Ltd.) lighted at 18 V while keeping the distance between the light source and the photographic material at 1 meter. The exposed material was then developed with a chemical developer solution of the following formulation at 20° C. for 30 seconds, briefly washed with water, and immersed in a fixation bath of the following formulation to dissolve the silver halide in the unexposed area and fix the developed image.

| Formulation of Chemical Developer Solution | |
|---|---|
| Water | 500 ml |
| p-(Methylamino)phenol Sulfate | 1 g |
| Sodium Sulfite (anhydrous) | 28 g |
| Hydroquinone | 8 g |
| Sodium Carbonate (monohydrate) | 24 g |
| Potassium Bromide | 2 g |
| Additional Water to make | 1 liter |
| **Formulation of Fixation bath** | |
| Water | 500 ml |
| Sodium Thiosulfate (pentahydrate) | 200 g |
| Sodium Hydrogen Sulfite | 25 g |
| Additional Water to make | 1 liter |

The photographic material was then washed with water for 10 seconds, and then immersed in Physical Developer Solution (23) of the following formulation at 60° C. for 3 minutes under normal room illumination, and finally washed with water for 1 minute, and dried.

| Nickel Physical Developer Solution (23) | |
|---|---|
| Water | 500 ml |
| Nickel (II) Chloride (hexahydrate) | 24 g |
| Gluconic Acid (about 50% by weight aqueous solution) | 240 g |
| Dimethylamine Borane | 12 g |
| Aqueous Ammonia (28% by weight) added to adjust the pH to | 9.0 |
| Additional Water to make | 1 liter |

Nickel was deposited on the chemically developed image in the exposed area. The optical density of the photographic image obtained by chemical development was 0.2, whereas after physical development, the optical density increased to more than 4. A clear positive letter-bearing image was obtained. It was found that the content of silver in the photographic layer could be further decreased.

EXAMPLE 24

A photographic material having an emulsion layer of the following formulation was produced.

| Formulation of Emulsion | |
|---|---|
| Raw Emulsion (as described in Example 23) | 50 g |
| Gelatin | 17 g |
| Mucochloric Acid (2% by weight aqueous solution) | 24 ml |
| Sodium Alkylbenzenesulfonate (1% by weight aqueous solution) | 17 ml |
| Sodium Carbonate (5% by weight aqueous solution) | 5 ml |
| 4-Hydroxy-6-methyl-1,3,3a,7-tetra-azaindene (0.5% by weight aqueous solution) | 25 ml |
| Water | 400 ml |

This photographic material contained silver in an amount of 33 $\mu$g per cm$^2$, which amount was about 1/15 of that in an ordinary lithographic high contrast photographic material of this type.

The resulting photographic material was exposed at 18 V for 10 seconds through a step wedge [wedge constant (step density difference); 0.15, maximum optical density; 4.5] on which was superimposed a contact screen (gray contact screen for halftone negatives, standard reproducible density area 1.2; made by Dainippon Screen Mfg. Co., Ltd.). The exposed material was developed with a chemical developer solution of the following formulation at 20° C. for 45 seconds. Otherwise, the same procedure as in Example 23 was repeated.

| Formulation of Chemical Developer Solution | |
|---|---|
| Water | 500 ml |
| p-(Methylamino)phenol Sulfate | 1 g |
| Sodium Sulfite (anhydrous) | 75 g |
| Hydroquinone | 9 g |
| Sodium Carbonate (monohydrate) | 29 g |
| Potassium Bromide | 6 g |
| Additional Water to make | 1 liter |

A strip having superior tone reproduction and having a halftone negative nickel image was obtained.

EXAMPLE 25

An antihalation layer was coated on one surface of a sub-coated 0.18 mm-thick polyethylene terephthalate film, and an aqueous solution of gelatin containing physical development nuclei and having the following formulation was coated on the other surface and dried at 40° C. for 10 minutes to form a diffusion transfer image-receiving layer having a thickness of 0.5 $\mu$m (dry thickness).

| Formulation of Aqueous Gelatin Solution | |
|---|---|
| Aqueous Dispersion of Nickel Sulfide/Gelatin (containing $5 \times 10^{-4}$% by weight of nickel sulfide and 0.5% by weight of gelatin) | 0.6 g |
| Gelatin | 0.6 g |
| Water | 100 ml |
| Mucochloric Acid (2% by weight aqueous solution) | 2 ml |
| Glycerin | 0.25 g |

The same emulsion composition as described in Example 24 (except that mucochloric acid was not present) was coated on the image-receiving layer in a dry thickness of 2 $\mu$m to produce a multilayered diffusion transfer photographic material. The photographic material was exposed in the same manner as in Example 24, and developed with a diffusion transfer developer solution of the following formulation at 25° C. for 30 seconds.

| Formulation of Diffusion Transfer Developer Solution | |
|---|---|
| Water | 500 ml |
| 1-Phenyl-3-pyrazolidone | 1 g |
| Sodium Sulfite (anhydrous) | 60 g |
| Hydroquinone | 15 g |
| Sodium Hydroxide | 20 g |
| Sodium Thiosulfate (pentahydrate) | 10 g |
| Potassium Bromide | 1 g |
| Additional Water to make | 1 liter |

The developed material was treated with warm water at 50° C. to remove the negative emulsion layer, and a positive halftone silver photographic image was obtained Otherwise, the procedure of Example 23 was repeated to obtain a strip of good quality having a halftone nickel image.

EXAMPLE 26

A lithographic silver chlorobromide film (average silver halide grain size; 0.3 $\mu$m, silver chloride; 70 mole%, silver bromide; 30 mole%, coating amount; about 5 g/m$^2$ as silver) was exposed through a negative transparency bearing letters for 90 seconds using a Dry Photo-Copier (a printer with a rating of 110 V, 15 A, the distance between the tungsten-filament lamp and the negative being about 2 cm; a product of the 3M Company). The lighographic film was then immersed for 30 seconds in a fixation bath of the following formulation, and then washed with water for 10 seconds to obtain a silver image precipitated by exposure.

| Formulation of Fixation Bath | |
|---|---|
| Water | 500 ml |
| Sodium Thiosulfate (pentahydrate) | 300 g |
| Sodium Sulfite (anhydrous) | 15 g |
| Glacial Acetic Acid | 12 ml |
| Potassium Alum [$KAl(SO_4)_2 \cdot 12H_2O$] | 20 g |
| Additional Water to make | 1 liter |

The optical density obtained by exposure was 0.13. After washing with water, the film was dipped in nickel Physical Developer Solution (23) as described in Example 23 for 2 minutes at 65° C. A nickel image was formed on the light deposited silver. The nickel image had a optical density of more than 4.

EXAMPLE 27

The procedure of Example 23 was repeated except that a motion-picture fine-grain positive film coated with a fine-grain silver iodobromide-gelatin emulsion (average silver halide grain size; 0.2 $\mu$m, silver iodide; 2.5 mole%, silver bromide; 97.5 mole%; coating amount; about 3 g/m$^2$ as silver) was used. Just as in Example 23, nickel deposited on the developed silver in the exposed area, and a negative image was obtained.

EXAMPLE 28

The procedure of Example 23 was repeated except that a high resolution dry plate coated with an ultra fine-grain silver iodobromide-gelatin emulsion (average silver halide grain size; 0.05 μm. silver iodide; 5 mole%, silver bromide; 95 mole%, coating amount; about 2.5 g/m² as silver) was used, and exposed imagewise for 30 seconds by lighting the same light source as in Example 23 at 18 V. Just as in Example 23, nickel deposited on the developed silver in the exposed area, and a negative image was obtained.

EXAMPLE 29

The procedure of Example 23 was repeated except that a microfilm coated with a fine-grain silver chlorobromide-gelatin emulsion (average silver halide grain size; less than 0.1 μm, silver iodide; 5 mole%, silver bromide; 95 mole%, coating amount; about 2 g/m² as silver) was used. Just as in Example 23, nickel deposited on the developed silver in the exposed area, and a negative image was obtained.

EXAMPLE 30

The procedure of Example 23 was repeated except that a high speed indirect-photographing radiographic film coated with a silver iodobromide-gelatin emulsion (average silver halide grain size; 1.4 μm, silver iodide; 0.2 mole%, silver bromide; 99.8 mole%, coating amount; about 9.5 g/m² as silver) was used, and exposed imagewise for 1 second by lighting the same light source as used in Example 23 at 7 V. Just as in Example 23, nickel deposited on the developed silver in the exposed area, and a negative image was obtained.

EXAMPLE 31

The procedure of Example 23 was repeated except that a high speed (ASA 100) film coated with a silver iodobromide-gelatin emulsion (average silver halide grain size; 0.8 μm, silver iodide; 4 mole%, silver bromide; 96 mole%, coating amount; about 3.5 g/m² as silver) was used, and exposed for 1 second by lighting the same light source as used in Example 23 at 7 V. Just as in Example 23, nickel deposited on the developed silver in the exposed area, and a negative image was obtained.

EXAMPLE 32

The procedure of Example 27 was repeated except that physical development was performed at 70° C. for 5 minutes using Physical Developer Solution (32) of the following formulation.

| Formulation of Cobalt Physical Developer Solution (32) | |
|---|---|
| Water | 500 ml |
| Cobalt (II) Chloride (hexahydrate) | 24 g |
| Gluconic Acid (about 50% by weight aqueous solution) | 240 g |
| Aqueous Ammonia (28% by weight) to adjust the pH to | 9.0 |
| Dimethylamine Borane | 12 g |
| Additional Water to make | 1 liter |

Cobalt deposited on the developed silver in the exposed area, and a negative image was obtained.

EXAMPLE 33

The procedure of Example 27 was repeated except that physical development was performed at 80° C. for 8 minutes using Physical Developer Solution (33) of the following formulation.

| Formulation of Nickel Physical Developer Solution (33) | |
|---|---|
| Water | 500 ml |
| Nickel (II) Chloride (hexahydrate) | 40 g |
| Lactic Acid | 40 g |
| Aqueous Ammonia (28% by weight) to adjust the pH to | 6.4 |
| Dimethylamine Borane | 20 g |
| Additional Water to make | 1 liter |

Nickel deposited on the developed silver in the exposed area, and a negative image was obtained.

EXAMPLE 34

The procedure of Example 23 was repeated except that an auto-positive film coated with a silver iodobromide-gelatin emulsion (average silver halide grain size; 1.1 μm, silver iodide; 1.5 mole%, silver bromide; 98.5 mole%, coating amount; about 4 g/m² as silver) was used, and exposed imagewise for 10 seconds by lighting the same light source as used in Example 23 at 18 V. Just as in Example 23, nickel deposited on the developed silver in the unexposed area, and a positive image was obtained.

EXAMPLE 35

The procedure of Example 23 was repeated except that the same type of photographic material as described in Example 34 was used, and subjected to flash exposure 100 times using a xenon flash discharge lamp [Stroboscope Model S-8A; flash time (half value width); 5000 μ seconds; flash peak illumination; about 10 million lux; color temperature; 6500° K.; distance between the light source and the photographic material; 27.5 cm, flashing interval 0.5 second; a product of Sugahara Laboratory] as a light source in a bright room (luminosity 50 lux). By handling the photographic material in the bright room, the positive image completely disappeared, and a negative image due to flash exposure appeared. Just as in Example 23, nickel deposited on the developed silver in the flash-exposed area, and a negative image was obtained.

EXAMPLE 36

A solution of the following formulation was coated at a dry thickness of 2 μm on a subbing layer of a film prepared in the same manner as in Example 23.

| Formulation of Solution | |
|---|---|
| Water | 1000 g |
| Gelatin | 30 g |
| Mucochloric Acid (2% by weight aqueous solution) | 30 ml |

The resulting gelatin-coated film was immersed for 1 minute in Solution A of the following formulation, washed for 1 minute with water, and immersed in Solution B of the following formulation at 50° C. for 30 seconds, followed by washing with water.

| Solution A | |
|---|---|
| Water | 500 ml |
| Palladium (II) Chloride (anhydrous) | 1 g |
| Hydrochloric Acid (37% by weight aqueous solution) | 10 ml |
| Additional Water to make | 1 liter |

-continued

| Solution B | |
|---|---|
| Water | 500 ml |
| Sodium Hypophosphite | 10 g |
| Additional Water to make | 1 liter |

Thus, nuclei for a silver complex salt diffusion transfer process were incorporated in the gelatin layer to form an image-receiving layer. The image-receiving layer was superimposed on an exposed (60 second exposure by lighting the same light source as used in Example 23 at 18 V) silver chloride negative photographic material (average silver halide grain size; 0.1 μm, coating amount; about 2 g/m$^2$ as silver). The developer solution described in Example 25 (20° C.) was interposed between them to perform development for 30 seconds. The negative photographic material was separated from the image-receiving layer, and a positive silver image with respect to the original was formed in the image-receiving layer. Otherwise, the same procedure as in Example 23 was employed. Just as in Example 23, nickel deposited on the positive silver image, and a positive image was obtained.

EXAMPLE 37

The procedure of Example 36 were repeated except that the image-receiving layer was produced by forming nuclei for diffusion transfer using Solution A of the following formulation.

| Solution A | |
|---|---|
| Water | 70 ml |
| Chloroauric Acid ($HAuCl_4 . 4H_2O$) | 1 g |
| Additional Water to make | 100 ml |

Just as in Example 36, nickel deposited on the positive silver image, and a positive image was obtained.

EXAMPLE 38

A lithographic silver chlorobromide film (average silver halide grain size; 0.3 μm, silver chloride; 70 mole%, silver bromide; 30 mole%, coating amount; about 5 g/m$^2$ as silver) was exposed for 50 seconds through an image-bearing negative using a printer (Dry Photo-Copier, a product of 3M Company). The exposed film was immersed in a 20% by weight aqueous solution of sodium thiosulfate for 2 minutes to fix the film, washed with water for 2 minutes, and dried to form an image-receiving layer comprising light deposited silver.

A silver chloride negative photographic material (average silver halide grain size; 0.1 μm, coating amount; about 2 g/m$^2$ as silver) was exposed imagewise for 60 seconds by lighting the same exposing device as used in Example 23 at 18 V with the photographic material placed at a distance of 1 meter from the light source. The exposed material was superimposed on the image-receiving layer, and the developer solution described in Example 25 (20° C.) was interposed between the assembly to perform development for 30 seconds. When the image-receiving layer was separated from the negative material, a positive image with respect to the original was obtained in the image-receiving layer. The positive image was treated subsequently in the same manner as in Example 23. Just as in Example 23, nickel deposited on the positive silver image, and a positive image was obtained.

EXAMPLE 39

A motion-picture fine-grain positive film coated with a fine-grain silver iodobromide-gelatin emulsion (average silver halide grain size; 0.2 μm, silver iodide; 2.5 mole%, silver bromide; 97.5 mole%, coating amount; about 3 g/m$^2$ as silver) was exposed for 15 seconds through an image-bearing negative by lighting the same light source as used in Example 23 at 18 V. The exposed film was immersed for 2 minutes in a 20 % by weight aqueous solution of sodium thiosulfate (pentahydrate) to fix the film, and the washed with water for 2 minutes. The film was again washed with distilled water, and immersed in a silver physical developer solution of the following formulation at 20° C. for 80 seconds.

| Silver Physical Developer Solution | |
|---|---|
| Solution A | |
| Silver Nitrate | 100 g |
| Water | 1 liter |
| Solution B | |
| Water | 500 ml |
| Citric Acid | 100 g |
| Sodium Citrate | 15 g |
| p-(Methylamino)phenol Sulfate | 10 g |
| Additional Water to make | 1 liter |

In use, 1 part of Solution A was mixed with 2 parts of Solution B.

The film was then washed with distilled water, and immersed in the nickel physical developer solution described in Example 23 for 5 minutes at 30° C. A nickel image deposited on the physically developed silver.

EXAMPLE 40

The procedure of Example 23 was repeated except that a silver chloride negative photographic material (average silver halide grain size; 0.1 μm, coating amount; about 2 g/m$^2$ as silver) was exposed for 60 seconds by lighting the same light source as used in Example 23 at 18 V, and then immersed for 30 seconds in the chemical developer solution used in Example 25 thereby to perform development and fixation simultaneously. Just as in Example 23, nickel deposited on the silver image in the exposed area, and a negative image was obtained.

EXAMPLE 41

The procedure of Example 3 was repeated except that Physical Developer Solution (7) described in Example 7 was used. Nickel deposited on, and intensified quite well, the silver image on the strip.

EXAMPLE 42

The procedure of Example 23 was repeated except that physical development was performed at 25° C. for 5 minutes using Physical Developer Solution (19) described in Example 19. Nickel deposited on, and intensified, the silver image.

EXAMPLE 43

The procedure of Example 23 was repeated except that physical development was performed at 25° C. for 5 minutes using Physical Developer Solution (20) described in Example 20. Nickel deposited on, and intensified, the silver image.

EXAMPLE 44

The procedure as in Example 23 was repeated except that physical development was performed at 25° C. for 5 minutes using Physical Developer Solution (21) described in Example 21. Nickel deposited on, and markedly intensified, the silver image.

EXAMPLE 45

Germanium having a purity of 99.999 % and sulfur were melted in vacuum, and rapidly cooled to obtain an inorganic material having the composition $GeS_{2.5}$ (the subscript showing the atomic ratio; hereinafter the same). 300mg of this inorganic material was used as an evaporation source and placed in an alumina-coated tungsten basket disposed in a vacuum deposition device. A 100 μm-thick polyethylene terephthalate substrate was disposed within the vacuum deposition device in an arc shape at a position about 30 cm apart from the evaporation source. The vacuum deposition device was operated, and in a vacuum of $5\times10^{-5}$ torr, the inorganic substance was vacuum-deposited on the polyethylene terephthalate substrate until the amount of the substance deposited became 30 μg/cm$^2$. Then, 50 mg of silver having a purity of 99.999% was placed in the tungsten basket as an evaporation source, and deposited on the substrate in a vacuum of $5\times10^{-5}$ torr until the amount of silver deposited became 5 μg/cm$^2$. A film having an image pattern was brought into close contact with the $GeS_{2.5}$-Ag multilayered film vacuum-deposited on the polyethylene terephthalate substrate, and the assembly was exposed for 10 minutes using a PS light (metal halide lamp, 2 KW) at a distance of 1 m from the assembly. The exposed material was then physically developed at 60° C. for 2 minutes using Physical Developer Solution (45) of the following composition. As a result of physical development, nickel metal deposited on the silver in the unexposed area, and a clear image (optical density 1.5) was obtained.

| Formulation of Nickel Physical Developer Solution (45) | |
|---|---|
| Water | 80 ml |
| Nickel (II) Chloride (hexahydrate) | 2.4 g |
| Gluconic Acid (about 50% by weight aqueous solution) | 24 ml |
| Monoethanolamine | 10 ml |
| Dimethylamine Borane | 1.2 g |
| Sodium Borohydride | 0.1 g |

EXAMPLE 46

The procedure of Example 45 was repeated except that $GeS_{4.0}$ (amount vacuum-deposited; 30 μg/cm$^2$) and Ag (amount vacuum-deposited; 10 μg/cm$^2$) were used instead of $GeS_{2.5}$ as in Example 45. The results were the same as in Example 45.

EXAMPLE 47

The procedure of Example 45 was repeated except that $As_2S_3$ (amount vacuum-deposited; 15 μg/cm$^2$) and Ag (amount vacuum-deposited; 5 μg/cm$^2$) were used instead of $GeS_{2.5}$ as in Example 45. The results were the same as in Example 45.

EXAMPLE 48

400 mg of a material having the composition $GeS_{2.5}$ which had been obtained by melting Ge having a purity of 99.999% and S in a vacuum and then rapidly cooling the melt was put into an alumina-coated tungsten basket disposed in a vacuum deposition device. A polyethylene terephthalate substrate having a thickness of 100 μm was disposed in an arc shape within the vacuum deposition device at a position about 30 cm apart from the evaporation source. The above substance was vacuum-deposited in a vacuum of $5\times10^{-5}$ torr until a monitor attached to the device indicated that the amount of material deposited was 36 μg/cm$^2$. The polyethylene terephthalate substrate so treated was then immersed for 60 seconds in a 0.5% by weight aqueous solution of silver nitrate, washed with water for 30 seconds, immersed in ethanol for 3 seconds, and dried at room temperature. (about 23° C.). The amount of silver deposited was 10 μg/cm$^2$. Subsequently, the material was treated using the same procedure as in Example 45. A clear nickel image was similarly obtained.

EXAMPLE 49

A photographic material prepared in the same manner as in Example 45 was exposed imagewise in the same manner as in Example 45. The exposed material was physically developed with Physical Developer Solution (49) of the following formulation at 50° C. for 3 minutes. As a result of the physical development, nickel metal deposited on the silver in the unexposed area as a nucleus, and a clear image (optical density 1.5) was obtained.

| Formulation of Nickel Physical Developer Solution (49) | |
|---|---|
| Water | 80 ml |
| Nickel (II) Chloride (hexahydrate) | 2.4 g |
| Gluconic Acid (about 50% by weight aqueous solution) | 24 ml |
| Sodium Borohydride | 0.1 g |
| Dimethylamine Borane | 1.2 g |
| Aqueous Ammonia (28% by weight) to adjust the pH to | 9.0 |

EXAMPLE 50

The procedure of Example 49 was repeated except that a photographic material prepared in the same manner as in Example 46 was used. The results obtained were the same as in Example 49.

EXAMPLE 51

The procedure of Example 49 was repeated except that a photographic material prepared in the same manner as in Example 47 was used. The results obtained were the same as in Example 49.

EXAMPLE 52

The procedure of Example 49 was repeated except that a photographic material prepared in the same manner as in Example 48 was used. A similar clear nickel image was obtained.

While the present invention has been described in detail and with reference to specific embodiments thereof, it is apparent to one skilled in the art that various changes and modifications can be made therein without departing from the scope and the spirit of the present invention.

What we claim is:

1. A process for forming a photographic image, which comprises intensifying an unactivated silver image which comprises (a) a latent silver image of silver nuclei formed by light deposition in the exposed areas of a silver halide photographic element, (b) a silver image formed by chemical development in the exposed areas of a silver halide photograhic element, (c) a transferred silver image formed by a diffusion transfer process or (d) a silver image formed in the unexposed areas of a non-silver halide photographic element, said non-silver photographic element comprising a layer of a chalcogen compound and a layer of silver thereon or comprising a layer of a mixture of a chalcogen compound and silver; by applying to said silver image a non-silver physical developer solution containing (1) at least one boron compound selected from the group consisting of amine borane compounds and boronhydride compounds, (2) at least one compound selected from the group consisting of amine compounds, and (3) a compound of a non-silver metal more base than silver; wherein said amine borane compound (1) is represented by the general formula (Ia)

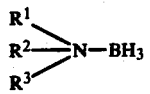

(Ia)

wherein $R^1$, $R^2$ and $R^3$, which may be the same or different, each represents an alkyl group, an aralkyl group, an aryl group, an amino group or a hydrogen atom, in which said alkyl group, said aralkyl group and said aryl group may be substituted with one or more of a hydroxyl group and an amino group; with the proviso that when one of $R^1$, $R^2$ or $R^3$ is an amino group, the other two of $R^1$, $R^2$ and $R^3$ are not amino groups and all of $R^1$, $R^2$ and $R^3$ are not simultaneously hydrogen atoms; or by the general formula (Ib)

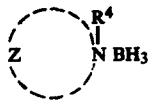

(Ib)

wherein $R^4$ represents an alkyl group, an aralkyl group, an aryl group or a hydrogen atom, and Z represents an atomic grouping necessary to form a saturated or unsaturated aromatic 5- or 6membered N-containing heterocyclic ring, and when there is a double bond to the N atom, $R^4$ is not present, and wherein $R^4$ and said atomic grouping formed by Z may be substituted with one or more of a hydroxyl group and an amino group; said borohydride compound (1) is at least one compound selected from the group consisting of compounds of the formula (Ic)

$$MBH_4 \quad \text{(Ic)}$$

wherein M is an alkali metal atom; and said amine compound (2) is represented by the general formula (IIa)

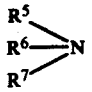

(IIa)

wherein $R^5$, $R^6$ and $R^7$, which may be the same or different, each represents an alkyl group, an aralkyl group, an aryl group, an amino group or a hydrogen atom, in which said alkyl group, said aralkyl group and said aryl group may be substituted with one or more of a hydroxyl group and an amino group; with the proviso that when one of $R^5$, $R^6$ or $R^7$ is an amino group, the other two of $R^5$, $R^6$ and $R^7$ are not amino groups and all of $R^5$, $R^6$ and $R^7$ are not simultaneously hydrogen atoms; or by the general formula (IIb)

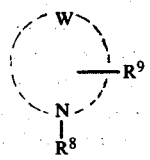

(IIb)

wherein W represents an atomic grouping necessary to form a saturated or unsaturated aromatic 5-, 6- or 7-membered heterocyclic ring; $R^8$ has the same meaning an $R^5$, and $R^9$ has the same meaning as $R^5$ or additionally represents a hydroxyl group, an amino group, a mono- or di-alkylamino group, an oxo group, an alkoxycarbonyl group, an amido group, an acyloxy group, an alkoxy group, an aryloxy group, a cyano group or a halogen atom, or a salt of a compound of formula (IIa) or (IIb) with acetic acid, propionic acid, oxalic acid, citric acid, sulfuric acid, nitric acid, phosphoric acid, carbonic acid, hydrogen chloride, hydrogen bromide or hydrogen iodide, with the proviso that when there is a double bond to the N atom, $R^8$ is not present;

wherein, when present in said physical developer solution, said amine borane compound is present in an amount of about 0.1 grams per liter to a saturated amount; when present in said physical developer solution, said borohydride compound is present in an amount of about 0.01 grams per liter to a saturated amount; said amine compound is present in an amount of about 0.1 grams per liter to a saturated amount; and said non-silver metal compound is present in an amount of about 0.01 to about 1 mole per liter; and with the proviso that (i) where said boron compound (1) is a borohydride compound of the formula (Ic), said process is conducted at a temperature of about 15° C. to about 70° C.;

(ii) where said boron compound (1) is an amine borane compound of the formula (Ia) or (Ib) and is present in said physical developer solution in an amount of at least about 100 grams per liter of said physical developer solution, said process is conducted at a temperature of about 18° C. to about 95° C;

(iii) where said boron compound (1) is an amine borane compound of the formula (Ia) or (Ib) and is present in said physical developer solution in an amount of about 40 grams or less per liter of said physical developer solution, said process is conducted at a temperature of about 30° C. to about 95° C.;

(iv) where said boron compound (1) is an amine borane compound of the formula (Ia) or (Ib) and is present in said physical developer solution in an amount of about 40 grams to about 100 grams per liter of said physical developer solution, said process is conducted at a temperature within the range specified by a lower limit T where $$T=0.2M+38$$

wherein T is the temperature in ° C. and N is the amount of said amine borane compound in grams per liter of said physical developer solution and an upper limit of 95° C.; and (v) where said physical developer solution contains (1) an amine borane compound and a borohydride compound, said amine borane compound being present in an amount of about 40 grams or less per liter of the physical developer solution and the ratio of said borohydride compound to said amine borane compound is about 3:1 or less, said process is conducted at a temperature of about 30° C. to about 95° C.

2. The process of claim 1, wherein said compound of the formula (Ic) is lithium borohydride, sodium borohydride or potassium borohydride.

3. The process of claim 1, wherein said compound of a non-silver metal is a compound of a Group VIII metal or a Group IB metal.

4. The process of claim 3, wherein said compound of a non-silver metal is a water soluble salt of nickel, cobalt, iron or copper.

5. The process of claim 4, wherein said compound of a non-silver metal is nickel (II) chloride, cobalt (II) chloride, copper (II) chloride, copper (II) sulfate, nickel (II) sulfate, cobalt (II) sulfate, iron (II) sulfate, nickel (II) acetate, cobalt (II) acetate, copper (II) acetate, copper (II) formate, nickel (II) nitrate, cobalt (II) nitrate, copper (II) nitrate, hexamminecobalt (III) chloride or hexamminenickel (II) chloride.

* * * * *